US005282611A

United States Patent [19]

Ueda et al.

[11] Patent Number: 5,282,611

[45] Date of Patent: Feb. 1, 1994

[54] SHEET SORTER HAVING NON-SORTING MODE WITH SUPPORT EXPANDING CAPABILITY

[75] Inventors: Noriyoshi Ueda, Yokohama; Katsuhito Kato, Kawasaki, both of Japan

[73] Assignee: Canon Kabushiki Kaisha, Tokyo, Japan

[21] Appl. No.: 909,219

[22] Filed: Jul. 6, 1992

[30] Foreign Application Priority Data

Jul. 6, 1991 [JP] Japan ..... 3-192632

[51] Int. Cl.[5] ..... B42C 1/12; B65H 39/02

[52] U.S. Cl. ..... 270/53; 270/58; 271/270; 271/293; 355/322

[58] Field of Search ..... 270/45, 53, 58; 271/293, 294, 295, 202, 270; 355/321, 322, 324, 311

[56] References Cited

U.S. PATENT DOCUMENTS

| | | | |
|---|---|---|---|
| 4,938,467 | 7/1990 | Honjo et al. | 271/202 |
| 5,035,412 | 7/1991 | Hiroi et al. | 270/53 |
| 5,036,357 | 7/1991 | Nishimori et al. | 355/321 |
| 5,096,184 | 3/1992 | Maekawa et al. | 271/207 |
| 5,181,705 | 1/1993 | Ueda et al. | 271/202 X |

FOREIGN PATENT DOCUMENTS

| | | | |
|---|---|---|---|
| 72568 | 10/1980 | Japan | 270/31 |
| 56-78769 | 6/1981 | Japan . | |
| 56-78770 | 6/1981 | Japan . | |
| 57-4855 | 1/1982 | Japan . | |
| 57-4856 | 1/1982 | Japan . | |
| 1-197277 | 8/1989 | Japan . | |
| 2091703B | 6/1985 | United Kingdom . | |

*Primary Examiner*—Edward K. Look
*Assistant Examiner*—John Ryznic
*Attorney, Agent, or Firm*—Fitzpatrick, Cella, Harper & Scinto

[57] ABSTRACT

A sheet sorting apparatus operable in a sorting mode in which sheets are sorted and in a non-sorting mode in which the sheets are not sorted includes a plurality of bins for receiving and sorting the sheets; a stapler for stapling the sheets accommodated in the bins; wherein one of the plural bins functions to receive the sheets in the non-sorting mode; an expander for changing a sheet accommodating space of the bin for receiving the sheets in the non-sorting mode; and a controller for operating the expander to expand the accommodating space when a number of sheets received by the bin is larger than a staplable number of the sheets of the stapler.

14 Claims, 21 Drawing Sheets

SHEET SORTER HAVING NON-SORTING MODE WITH SUPPORT EXPANDING CAPABILITY

FIELD OF THE INVENTION AND RELATED ART

The present invention relates to a sheet sorting apparatus for sorting and stacking sheets discharged from an image forming apparatus.

Generally, the sorting apparatus of this kind comprises 10–20 or more sheet stacking bins with predetermined spaced between adjacent bins. The sheets continuously discharged with regular intervals from the image forming apparatus are received by the respective bins sequentially, using a belt conveying means, roller means or a combination thereof.

The sorting apparatuses are classified into a movable bin type in which the group of the sheet stacking bins is moved relative to a fixed sheet passage and a fixed bin type in which the groups of bins is fixed, while a sheet discharging unit is capable of discharging the sheets for the respective bins, or a deflecting flapper means directs the sheets from a fixed passage to the respective bins.

In the movable bin type sorter, the sheet inlet between the adjacent bins is expanded when the inlet is to receive the sheet, as disclosed in Japanese Laid-Open Patent Applications Nos. 78770/1981, 78769/1981, 4855/1982, 4856/1982, 441357/1982. For accomplishing this expansion, a pair of projections at lateral ends at the inlet side of each of the bins, are engaged with an expanding mechanism including a rotatable Geneva mechanism or a lead cam so as to expand the gap between the bins. The expanding mechanisms are stacked so that the bins are moved up and down as a whole.

Referring to FIGS. 18 and 19, there is shown a major part of such a sheet sorting apparatus. To the ends of each of plural bins Ba, Bb and Bc, trunnions 151*a*, 151*b* and 151*c*, which are guided for upward and downward movement by a pair of guide rails 152. The ends thereof are engageable with cam groove surfaces of the lead cams 153*a* and 153*b*, so that they are moved up and down by the rotation of the lead cams 153*a* and 153*b* in a direction A or a direction D opposite therefrom. When the trunnions 151*a* and 151*b* are in the lead cams 153*a* and 153*b*, the gap between the bins Ba and Bb and the gap between the bins Bb and Bc are locally expanded to facilitate reception of the sheet from the sheet discharging rollers 155. After reception of the sheet, the bins Ba and Bb or the like are sequentially stacked on the lower bins.

The upper surfaces of the lead cam 153*a* and 153*b* support the entirety of the bins (bin unit), so that the entire bin unit is moved up or down through a distance of a diameter of the trunnion 151 by one rotation of the lead cams 153*a* and 153*b*. In this manner, the required functions are provided with a simple mechanical structure.

Generally speaking, in a non-sorting mode in which the sheets are not sorted, an even greater number of sheets are to be stacked than in a sheet sorting mode in which the discharged sheets are sorted. To meet this requirement, as shown in FIG. 20, a prior art apparatus is provided with a sheet passage 71 exclusively for the non-sorting mode in addition to the sheet passage 70 for the sorting mode, so that a great number of sheets P from the discharging rollers 72 can be stacked through the sheet passage 71. These sheets are stacked on a bin 73 exclusively for this mode and disposed with a substantial distance. However, this structure results in bulkiness of the apparatus and a greater number of parts, and therefore, a costly apparatus.

If a great number of sheets are stacked using the sheet passage 71 and the bin B1 common to the shorting mode, in the non-sorting mode operation (FIG. 21), the already discharged sheets are suspended adjacent the discharging outlet of the conveying rollers 74. These suspended sheets interfere with the discharging sheet with the result of sheet jamming. This is particularly probable when the degree of curl of the sheets is large due to the change of the ambient conditions or the like. To avoid this problem, the prior art apparatus as shown in FIG. 23 is such that the topmost bin B1 is shifted down from its home position for the sorting mode, in the non-sorting mode to provide sufficient distance from the nip of the discharging rollers 74 to the topmost bin B1 (Japanese Laid-Open Patent Application No. 197277/1989, for example). The number of stackable sheets increases with increase of the shift down distance of the topmost bin B1.

However, with the structure, the bin unit is shifted down at the first discharged sheet in the non-sorting mode and the distance between the nip of the discharging rollers 75 and the topmost bin B1 is large as compared with the sorting mode, and therefore, the alignment of the sheets on the topmost bin is not satisfactory. The unsatisfactory alignment is a problem when the sheets are further subjected to the stapling operation or the like. In the sorting mode in which the distance between the nip of the discharging rollers 75 to the topmost bin is small, the leading portion of the discharging sheet slides on the surface of the bin or the surface of the topmost sheet on the bin, and therefore, the movement of the discharging sheet is impeded. Therefore, even if the kick-out speed of the discharging rollers 75 is high, the friction with the topmost sheet or the bin surface prevents the sheet from jumping too far, which will involve improper alignment because of insufficient return. However, when the distance between the nip of the discharging rollers 75 and the topmost bin is increased in the non-sorting mode, the friction between the leading portion of the discharging sheet and the bin surface or the topmost sheet thereon becomes smaller, and therefore, if the discharging rollers 75 are rotated at the same speed as in the sorting mode, the sheet jumps too far with the result of insufficient return of the sheet toward the aligning wall of the bin. This problem is more significant in the case of smaller size of the sheet, since then the friction is smaller.

SUMMARY OF THE INVENTION

Accordingly, it is a principal object of the present invention to provide a sheet sorting apparatus in which the alignment of the stacked sheets in the non-sorting mode is improved, and a large number of sheets can be stacked.

According to an aspect of the present invention, there is provided a sheet sorting apparatus operable in a sorting mode in which sheets are sorted and in a non-sorting mode in which the sheets are not sorted, comprising: a plurality of bins for receiving and sorting the sheets; binding means for stapling the sheets accommodated in said bins; wherein one of said plural bins functions to receive the sheets in the non-sorting mode; means for changing a sheet accommodating space of said bin for receiving the sheets in the non-sorting mode; and control means for operating said space changing means to expand the accommodating space when a number of sheets received by said bin is larger than a bindable number of the sheets of said binding means.

In the non-sorting mode, the gap is not so expanded as to the extent of the staplable number of sheets, and therefore, the distance between the sheet discharging position and the bin is small. Therefore, the alignment of the sheets is not deteriorated, thus permitting good stapling operation. When the number of sheets beyond the staplable number of the sheets, are to be received, the receiving gap is increased to provide the large distance to permit the reception of the large number of sheets. When the gap is expanded, the sheet discharging speed may be lowered so as to prevent the deterioration of the alignment.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
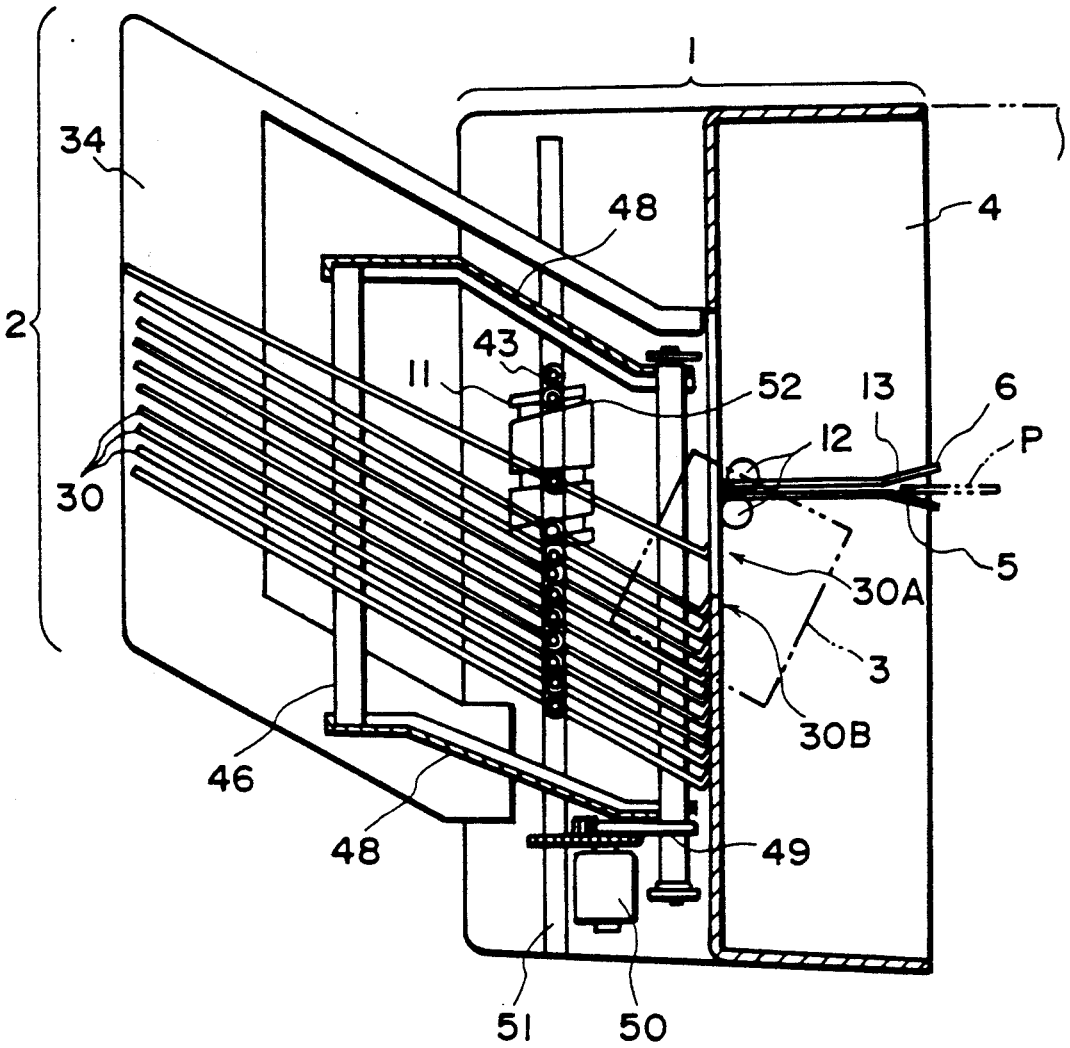
FIG. 1 is a longitudinal sectional view of a sheet sorting apparatus according to an embodiment of the present invention.
Figure 2:
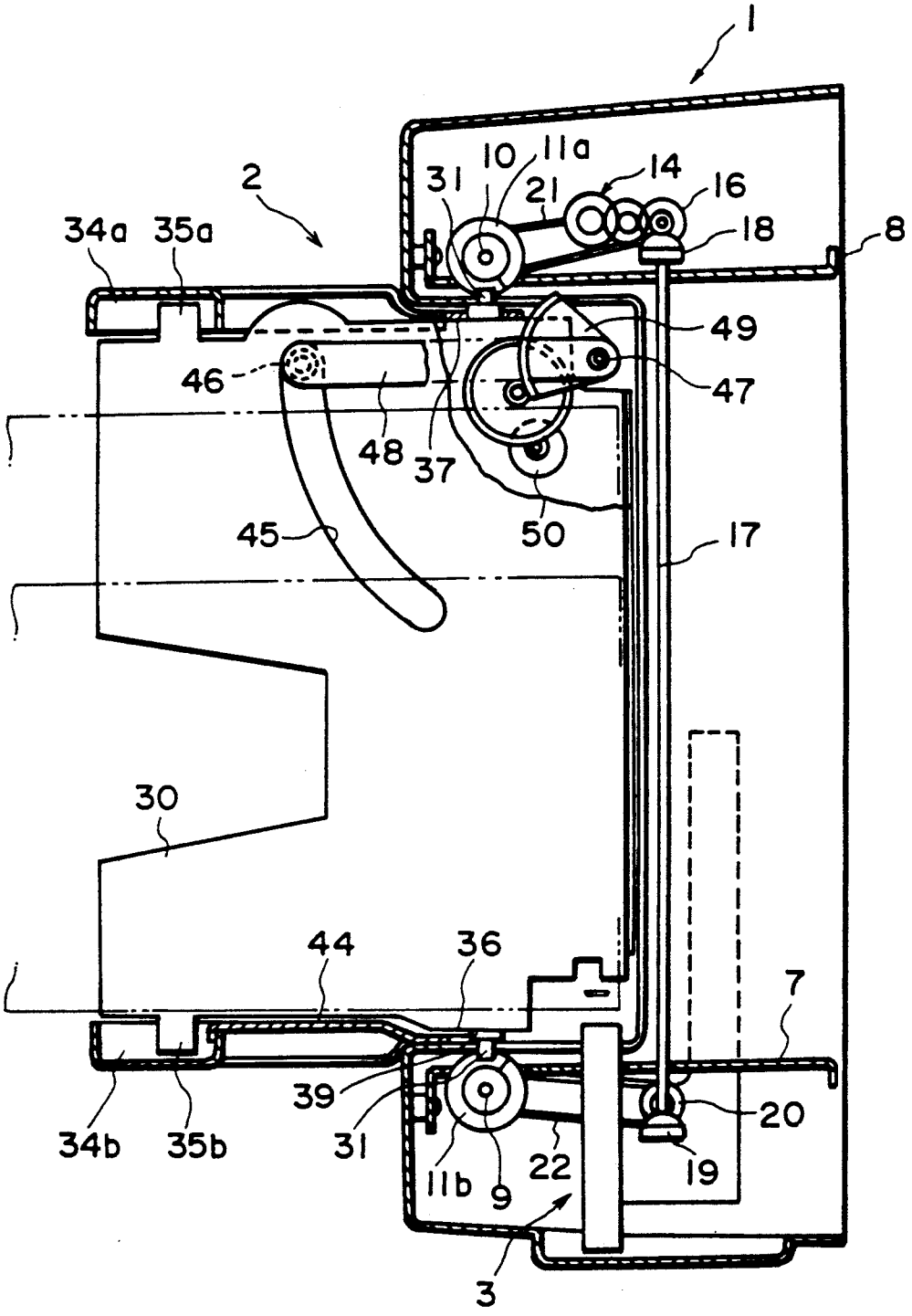
FIG. 2 is a sectional plan view thereof.
Figure 3:
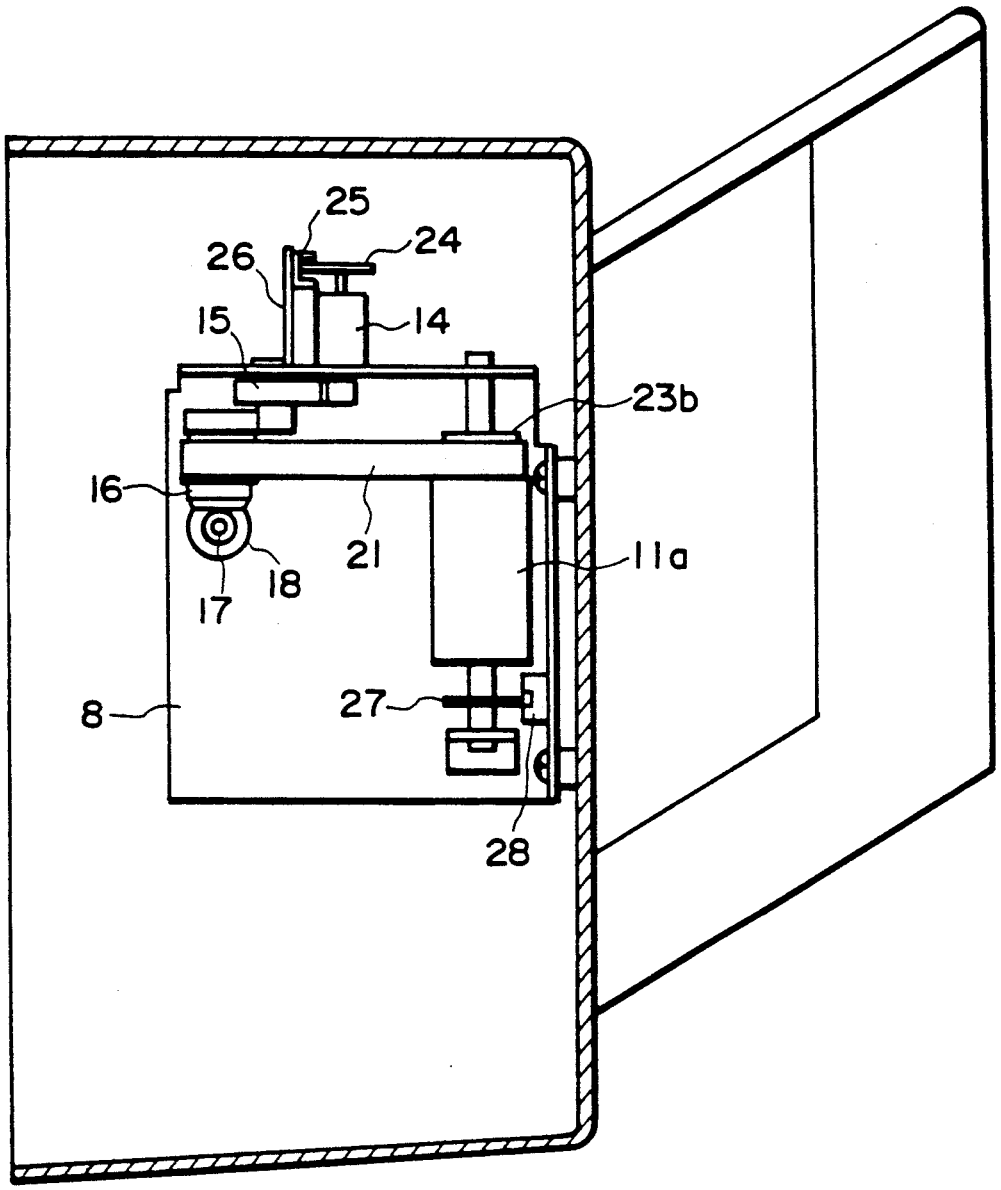
FIG. 3 is a longitudinal sectional view as seen from the opposite side.
Figure 4:
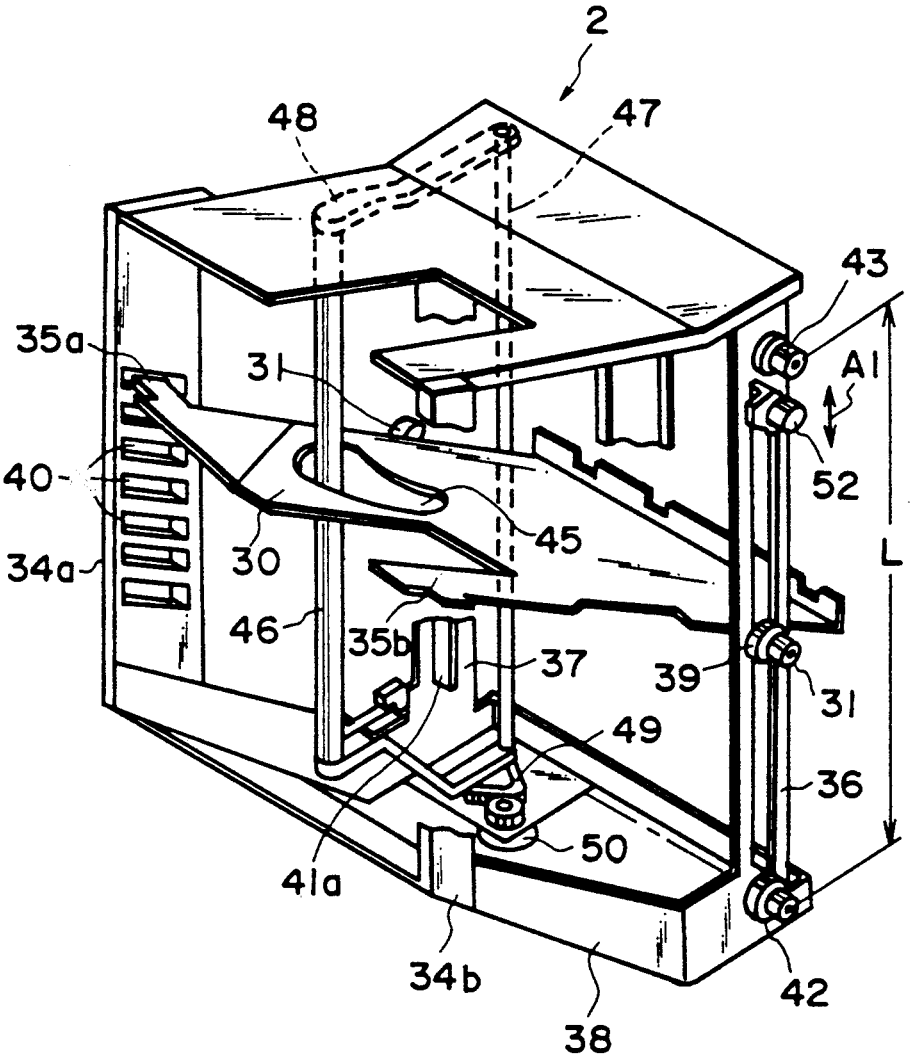
FIG. 4 is a perspective view of a bin unit.
Figure 5:
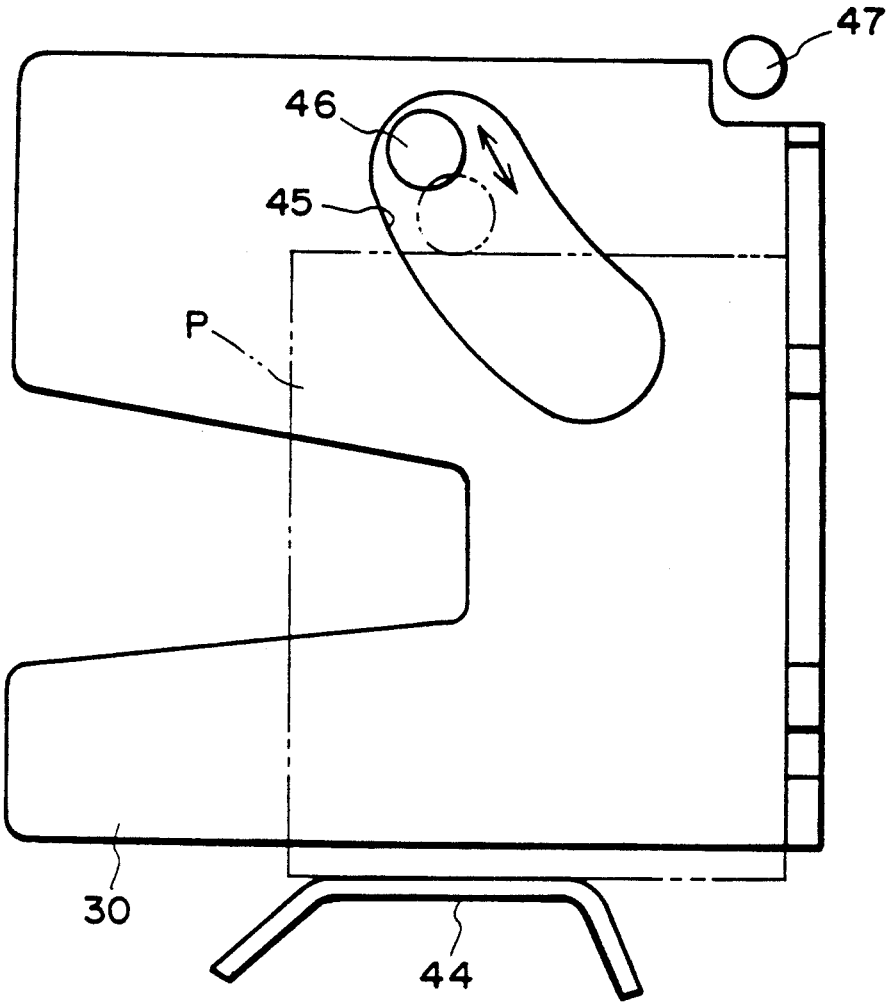
FIG. 5 is a top plan view of a bin and an aligning rod.

Referring to FIGS. 1-5, a sheet sorting apparatus according to a first embodiment of the present invention will be described. The sheet sorting apparatus of this embodiment comprises a sorter main assembly unit 1, a bin unit 2 and a spool unit 3.

The sorter main assembly unit 1 comprises a frame 4 integrally formed with a lower guide 5, an upper guide 6 corresponding to the lower guide 5, front and rear plates 7 and 8 (FIG. 2) mounted to the front and rear recesses of the frame 4, lead cams **11*b* and 11*a* rotatably mounted to shafts 9 and 10 on the front and rear plates 7 and 8, respectively, a pair of conveying rollers 12 mounted on the front and rear plates 7 and 8**.

Adjacent a sheet discharging outlet in the sheet conveying passage 13, there is disposed a sheet sensor (not shown) for detecting the sheet P. The sensor includes a photosensor and an actuator. In this embodiment, the sheet passing period and the inter-sheet gap can be measured. The detected signals are transmitted to a microcomputer in the sorter main assembly unit 1.

A reversible shift motor 14 (FIGS. 2 and 3) is mounted on a rear plate 8, and the driving force of the motor 14 is transmitted to a bevel gear 16 integrally mounted with a pulley **11*a* through a driving gear train 15, and the driving force F is further transmitted to the lead cam 11*a* from the bevel gear 16 to the lead cam 11*a* through the belt 21. The bevel gear 16 is engaged with another bevel gear 18 fixedly mounted on an end of a penetrating shaft 17, and a further bevel gear 19 fixedly mounted on the other end of the penetrating shaft 17 is meshed with a bevel gear 20 which is integral with the pulley. The bevel gear 20 is connected to a pulley 23*b* integral with the lead cam 11*b* through a belt 22. With such a drive transmission system, when the shift motor rotates in the forward or backward direction, the lead cam 11*a* and 11*b*** rotate in the forward or backward direction.

To the output shaft of the shift motor 16, a clock disk 24 is fixedly mounted to sense the revolution of the lead cam 11 and therefore the revolution of the shift motor 14, using a photointerruptor 25 mounted on the rear plate 8 with a sensor holder 26. Therefore, the revolution of the lead cam 11 can be controlled by an unshown shift motor control circuit of the sorter main assembly unit 1. In addition, a flag 27 is mounted on the bottom of the lead cam **11*a* coaxially therewith to detect the position of the lead cam 11*a*. A photosensor 28 for reading the flag 27 is fixedly mounted on the rear plate 8. The lead cam 11*a*, as will be described hereinafter, has a parallel portion (approx. 180 degrees). In this embodiment, the flag 27 is in the form of a sector of 180 degrees to detect the parallel portion. The description will be made as to bin unit 2. The bin unit 2 (FIGS. 2 and 4) is provided with 10 bins 30 for accommodating the sheets P discharged by the rollers 12. The bin 30 is provided with trunnions 31 at both lateral ends of the base side thereof, and the trunnions 31 are engageable with helical cam surfaces of the lead cams 11*a* and 11*b*. Adjacent an end thereof, it is provided with tongues 35*a* and 35*b* engageable with separators 34*a* and 34*b*. The bin 30 is supported by front and rear supporting plates 36 and 37 having guides for the trunnions 31 and by a bin frame 38 which is integral with the separators 34*a* and 34*b*. The bin 30 is further provided with supporting portions 39 having a predetermined diameter shown in FIG. 2, coaxially with the trunnions 31. The space or gap between adjacent bins 30 when the trunnions 31 are out of engagement with the lead cams 11, is maintained constant by the supporting portions 31, and grooves 40 which are formed in the separators 34*a* and 34*b*** with a predetermined pitch.

The supporting plates 36 and 37 have trunnions guides 41. To the lower part of the trunnion guide 41, a lower guiding pin 42 is fixedly mounted, and an upper unit 43 is mounted by screws above the lower guide pin 42 with a predetermined clearance L therefrom. A mounting surface of the upper guide pin 43 is stepwisely cut, and is slidable along the mounting groove, so that the mounting position of the upper guide pin 43 is slidable to adjust the clearance L. By adjusting the clearance L, the lead cams 11*a* and 11*b* can smoothly receive the trunnions 31, when the receiving portions of the lead cams 11*a* and 11*b* receive the trunnions 31. The front side of the bin frame 38 is provided with an aligning abutment 44 each of the bins 30 is provided with a cut-away portion 45. Through all the cut-away portions 45 an aligning rod 46 penetrates therethrough. The aligning rod 46 is mounted on a swingable arm 48 which is swingable about a shaft 47. The arm 48 is provided with a sector gear 49 engageable with a sector hole formed at the bottom portion of the arm 48. The sector gear 49 is driven by a reversible stepping motor 50 which is mounted on the bin frame 38. Therefore, when the stepping motor 50 rotates in the forward and backward direction, the aligning rod 46 swings in the direction indicated by an arrow (FIG. 5), so that the sheets P accommodating in the bins 30 are abutted to the aligning abutment 44, thus aligning the sheets.

The bin unit 2 moves up and down along the guide rails 51, while the upper and lower guide pins 43 and 42 are in engagement with the guide rails 51 formed in the frame 4. Therefore, the bin unit 2 can be correctly positioned relative to the shorter main assembly unit 1 in a direction Al. Between the upper guiding pin 43 and the trunnion 31 of the topmost bin 30, there is provided a dummy trunnions 52 at each of the front and rear sides. The dummy trunnion 52 has a rough guide engageable with the guiding portions 41 of the supporting plate 36 and 37 to permit smooth slide relative to the supporting plates 36 and 37.

Referring to FIGS. 7, 8, 9, 10, 11 and 12, the description will be made as to the structure of the stapling unit 3.

The stapling unit 3 comprises a frame 90; a rail 91 mounted on the frame 92; a stapler holder 93 smoothly slidable in a direction Z and holding a stapler 92; a stapler holder 93; a swinging plate 95 swingable about a pivot 94 of the frame 90, an arm 98 engageable with a latch (FIG. 10) of the stapler holder 93 and swingable about a pivot 98*a* of the frame 90; an eccentric cam 100 (FIG. 10) having a cam surface contacted to a roller 99 rotatably supported on the arm 98 to swing the arm 98; an eccentric roller 101 mounted on the same shaft 89 as the eccentric cam 100; a roller 102 contacted to the eccentric roller 101 and fixedly mounted on the swinging plate 95; and a stapling motor 104 mounted on the frame 90 and transmitting a driving force to be eccentric cam 100 and the eccentric roller 101 through a gear train 103. The stapling unit 3 is fixedly mounted on a front plate 7 of the sorter main assembly unit 1.

The description will be made as to the stapling unit 3.

Figure 10:
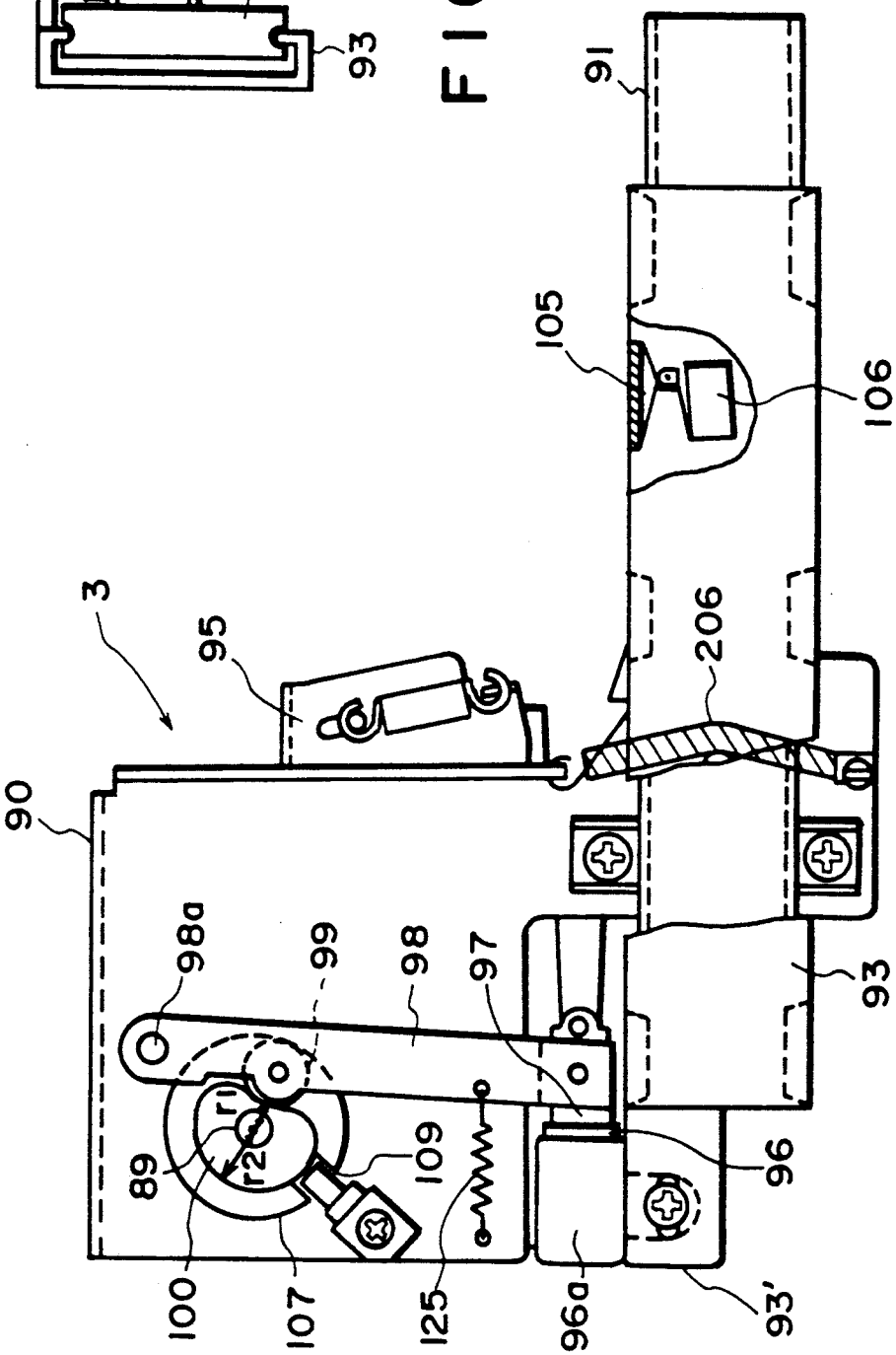
FIG. 10 is a side view of stapler unit disposed at a home position.
Figure 12:
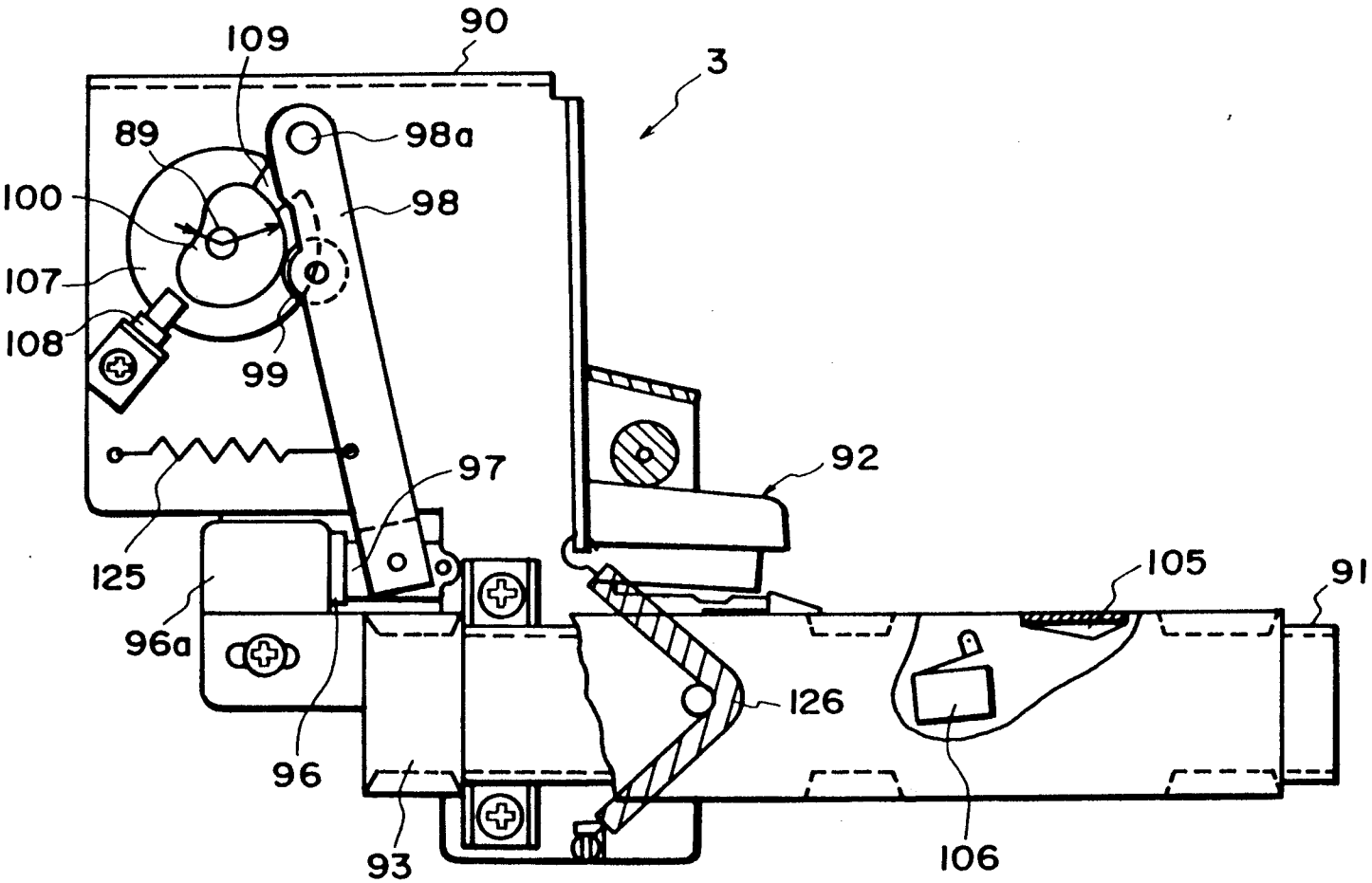
FIG. 12 illustrates operation of the stapler unit.

FIG. 10 shows the stapling unit 3 situated at its home position. When the stapling unit 3 is in the home position, a projection 105 formed on a rail portion of the stapler holder 93 actuates a microswitch SW106 mounted on the rail 91. The eccentric cam 100 is integrally provided with a sector flag 107. A slit 109 of the flag 107 is detected by a photosensor 108 mounted on the frame 90. The slit 109 is formed such that when the stapler 3 is at the home position, the photosensor 108 detects it.

Figure 8:
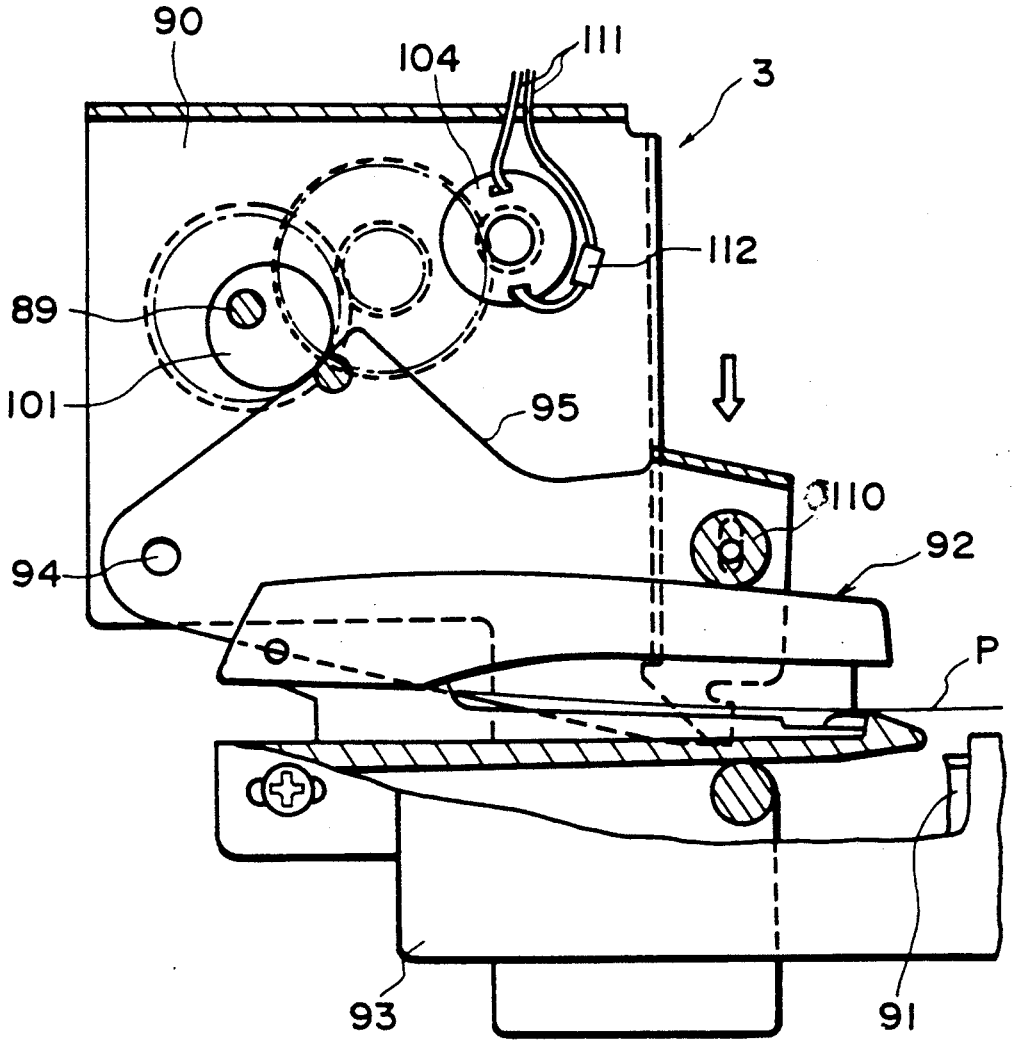
FIG. 8 is the same view to illustrate operation.

In response to a stapling instruction signal from the main assembly M (FIG. 1) of the copying machine or in response to a stapling instruction signal from the sorter main assembly 1 (actuation of the stapling button), an instruction signal is transmitted to a stapling motor 104 from a driver of the sorter main assembly, upon which the stapling motor 104 rotates. Then, the eccentric cam 100 and the eccentric roller 101 start to rotate. The description will now be made as to the operations of the eccentric cam 100 and the eccentric roller 101. The cam surface profile of the eccentric cam 100 is such that an outer diameter at the home position (0 degree) is r1; the outer diameter is r2 from 45–315 degrees in the clockwise direction; and the outer diameter is r1 again at 360 degrees. At the position where the outer diameter of the eccentric cam 100 is r2, the arm 98 is pressed by the eccentric cam 100 and is displaced. The arm 98 is urged to the eccentric cam 100 by a spring 125. The stapler holder 93 is moved to a clinching position shown in FIG. 12 in association with movement of the arm 98. When the eccentric cam 100 rotates to the position of the outer diameter of r1, the stapler holder 93 is returned to the home position from the clinching position. The eccentric roller 101 has a shaft 89 at a position r4 away from a center of a circle having a radius of r3. At the home position (FIG. 7), the outer diameter of the eccentric roller 101 is r3−r, and at the angular position of 180 degrees of the eccentric cam, the outer diameter is the maximum, that is, r3+r4. The roller 102 mounted on the swinging plate 102, is pressed by the eccentric roller 101 so that a pressing roller 110 displaces from the home position to the bottommost position in interrelation with the supporting plate 95. By the pressing roller 110 urging the backside of the stapler 92 mounted on the stapler holder 93, the stapler 92 carried out the clinching or stapling operation (FIG. 8). When the eccentric roller 101 further rotates to the angular position of 360 degrees, the stapler 92 returns to the home position. Since the eccentric cam 100 and the eccentric roller 101 are coaxial, the above operations are interrelated. In other words, by one rotations of the eccentric cam 100 and the eccentric roller 101, the stapling unit performs a series of operations of advancing movement of the stapler 92, the clinching action and return to the home position, by one motor 104.

Figure 9:
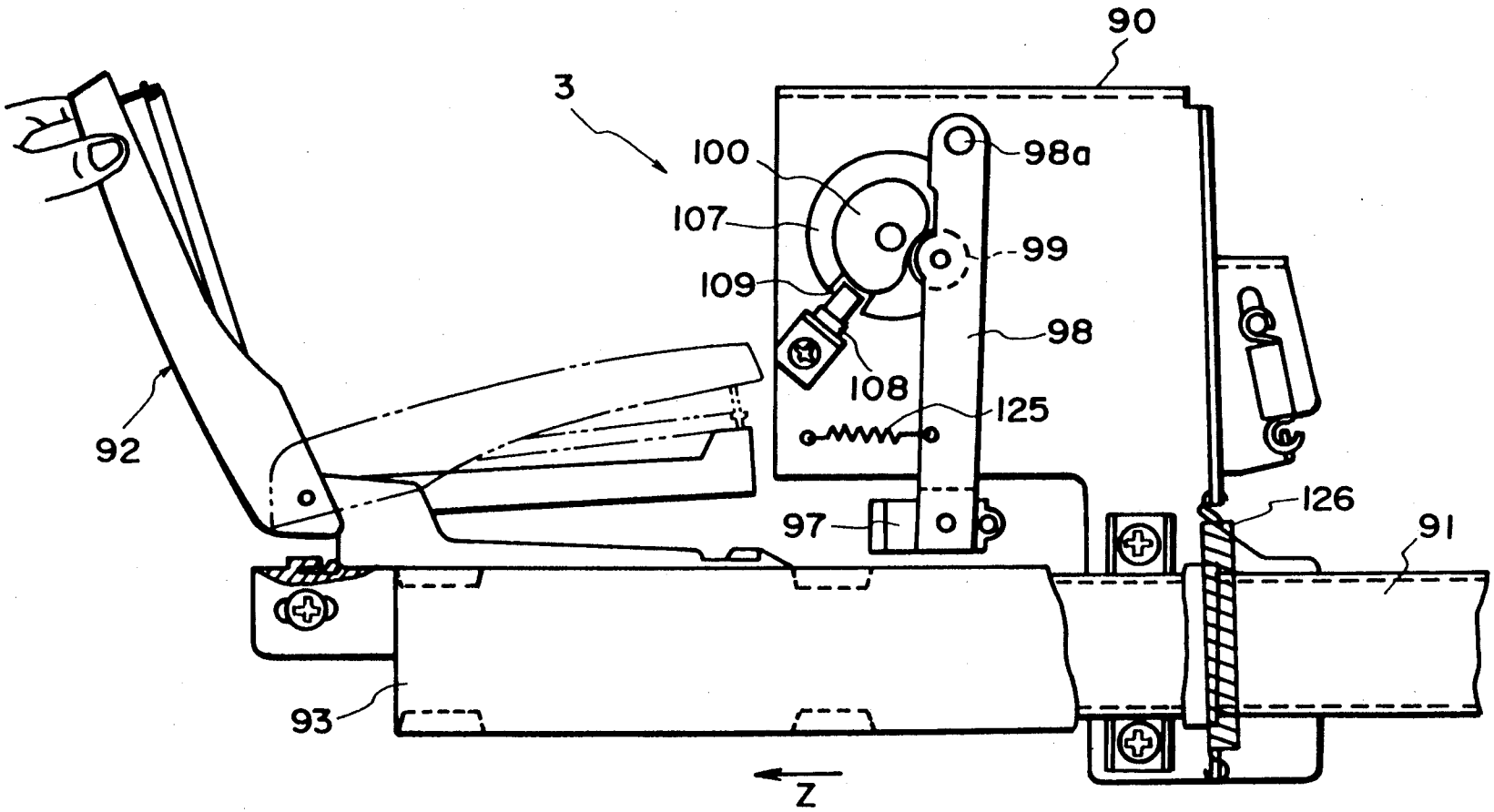
FIG. 9 is a side view of a stapler unit at a stapler removing position.
Figure 11:
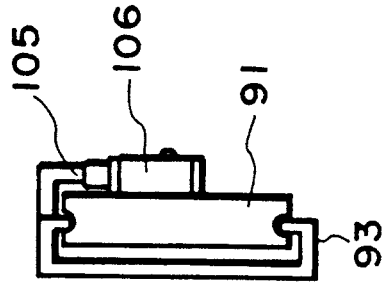
FIG. 11 is a front view of a stapler holder and rails.

In this embodiment, in order to make easier the staple rolling operation, the following structure is used. In FIG. 10, a push latch 96 is engageable with a pawl 97. The push latch 96 is locked by a latch holder 96*a*. The latch holder 96*a* is threaded on the stapler holder 93. Since the stapler holder 93 is urged in a direction Z by a spring 124 (FIG. 9), the stapler holder 93 is pushed in a direction Z by a spring 126 by pushing a hatched portion 93' of the stapler holder to release the push latch 96 from the pawl 97, as shown in FIG. 9. With the state of FIG. 9, the stapler 92 is completed released, and therefore, the user is permitted to load the staples without difficulty.

In this embodiment, the absence of the staples in the stapler 92 and the staple jam are detected in the following manner. A cable 111 supplied the driving current to the stapler motor 104, and a current sensor 112 functions as a load detecting means to detect the electric current through the cable 111.

Figure 13:
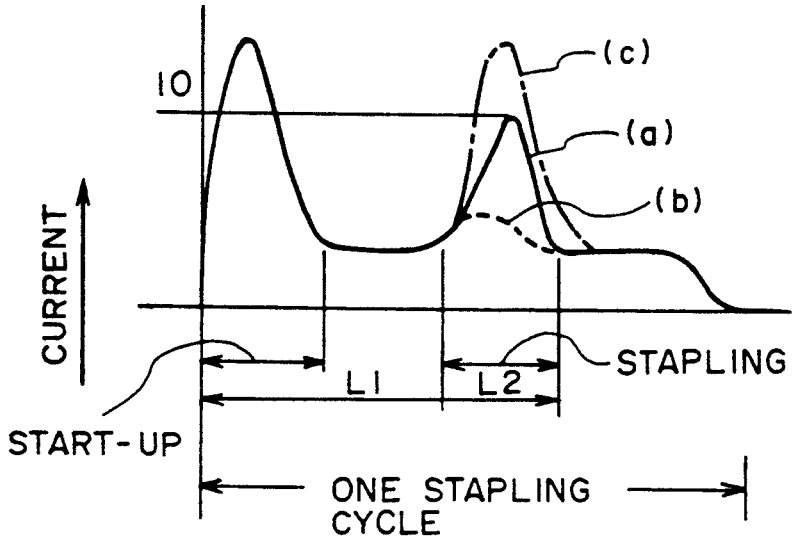
FIG. 13 shows a waveform of an electric current for a stapler motor.

FIG. 13 shows a waveform of the electric current through the stapler motor 104 detected by the current sensor 112 during one stroke of the stapling action.

A waveform (a) is the waveform when the staple is penetrated through the sheets and properly bent in good order. The waveform (b) is the one upon idle stapling (the staple is not dispensed when the stapler is actuated). Since there is no load for the penetration of the sheets and for the bending of the staple at the time of the idle stapling, the level of the electric current is low. A waveform (c) is the one upon the improper stapling and staple jamming with the general result of overload, which leads to the extremely high level electric current.

In this embodiment, the correct stapling operation is discriminated when the current level is Io (initial setting level). When $I > Io + C$ (C: variation), either staple jam, improper stapling action or abnormal stapler mechanism operation, is considered. When $I < Io + IC$, the idle stapling is discriminated.

Figure 14:
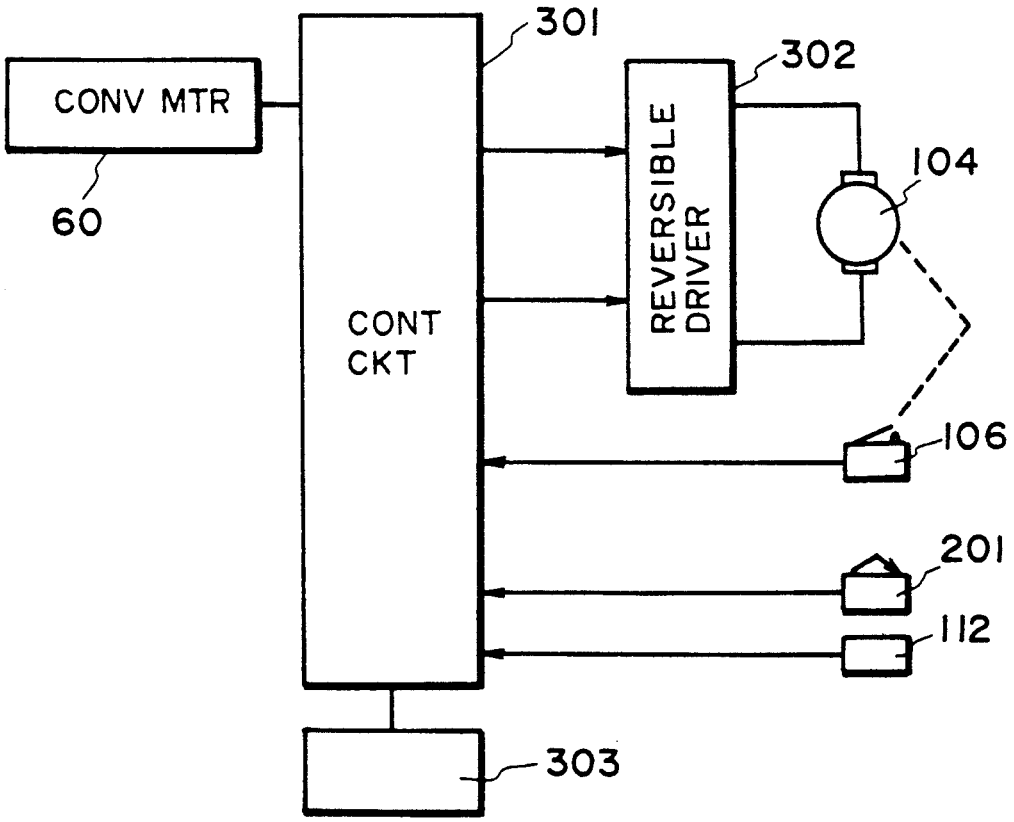
FIG. 14 is a block diagram of an electric circuit of a system for the apparatus according to an embodiment of the present invention.

Referring to FIG. 14, the electric control circuit will be described. A control circuit 301 functions as control means is in the form of a known microcomputer containing therein a sequential control program. Output terminals A and B of the control circuit 301 function to rotate the stapler motor 104 in the forward or backward direction. The outputs thereof are supplied to a forward-backward driver 302. When the output at the terminal A is at a high level, a normal stapling operation is carried out, and when the output terminal B is at a high level, a reversing operation at the abnormal situation is carried out.

When the stapler 92 is at the home position, the home position sensor 106 is in the urged state (ON). The signal indicative of that state is supplied to a C terminal of the control circuit 301. In either of the forward and backward operation of the motor, when the home position sensor 106 produces an output, the outputs at the terminals A and B of the control circuit 301, become low, so that the stapler roller 104 is stopped.

To the input terminal E, a detection signal of the electric current sensor 112 is supplied. Since the detection signal of the current sensor 112 is an analog signal, and therefore, it is converted to a digital signal in the control circuit 301. If the microcomputer does not have such a function, an A/D converter is used to supply the digitalized signal.

The control circuit 301 monitors the output signal of the current sensor 112, that is, the current level I flowing through the stapler roller 104. The improper state of the stapler is detected if the peak current Ip satisfies $Ip > Io + C$ for a predetermined period of time t2 after a predetermined period t1 elapses from start of the stapling operation.

The output terminal F supplies a display signal to a display device 303, and the display device 303 displays "malfunction of stapler" in response to the display signal.

Figure 15:
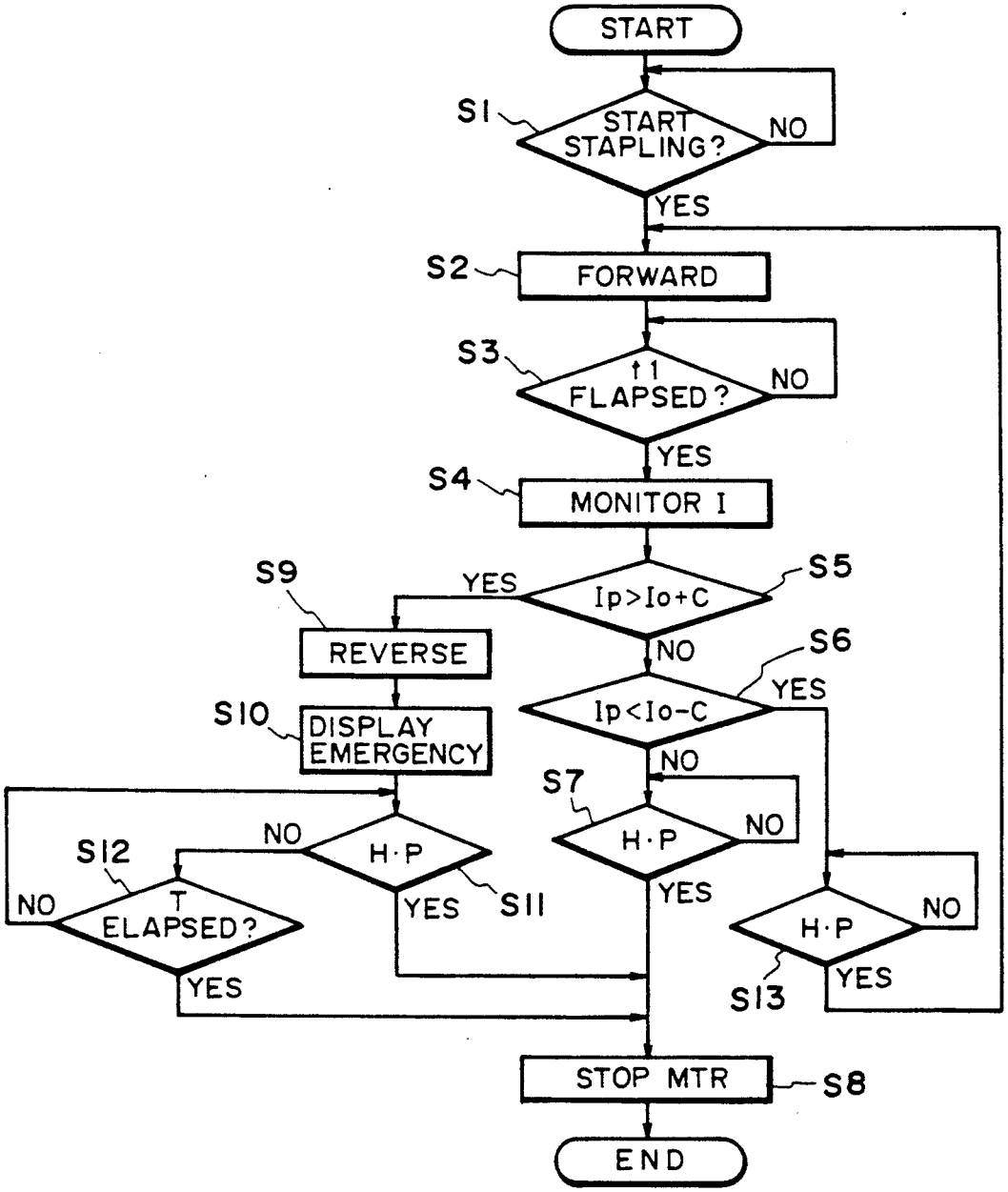
FIG. 15 is a flow chart of sequential operations of the stapler unit.

Referring to FIG. 15, the operation will be described. When the stapling operation start is discriminated at step S1, the output of the A terminal is made high at step S2 to rotate the stapler motor 104. At step S2, when the stapling operation starts after the predetermined period t1 elapses after start of the stapling operation. At step S4, the electric current I through the stapler motor 104 supplied to the terminal E, is monitored, and the peak current level Ip is determined. At steps S5 and S6, the discrimination is made as to whether the current Ip at proper level or not. If not improper, the return of the stapler to the home position is confirmed at step S7, and the motor 10 is stopped.

When $Ip > Io + C$, at step S5, that is, Ip is extremely large, the staple jam or the like is likely, and therefore, at step S9, the output of the terminal A is rendered off, and the output at terminal B is rendered on, so that the stapler motor 104 is rotated in the opposite direction.

At step S10, the malfunction of the stapler 92 is displayed on the display device 303. At step S11, the returning of the stapler 92 to the home position is confirmed, and then the stapler motor 104 is stopped. When it does not return to the home position even after a predetermined period T elapses after start of the reverse rotation of the stapler motor 104, it is discriminated that the stapler 92 is stopped halfway by the jamming, and therefore, the operation of step S8 is carried out to stop the motor, at step S12.

Figure 6:
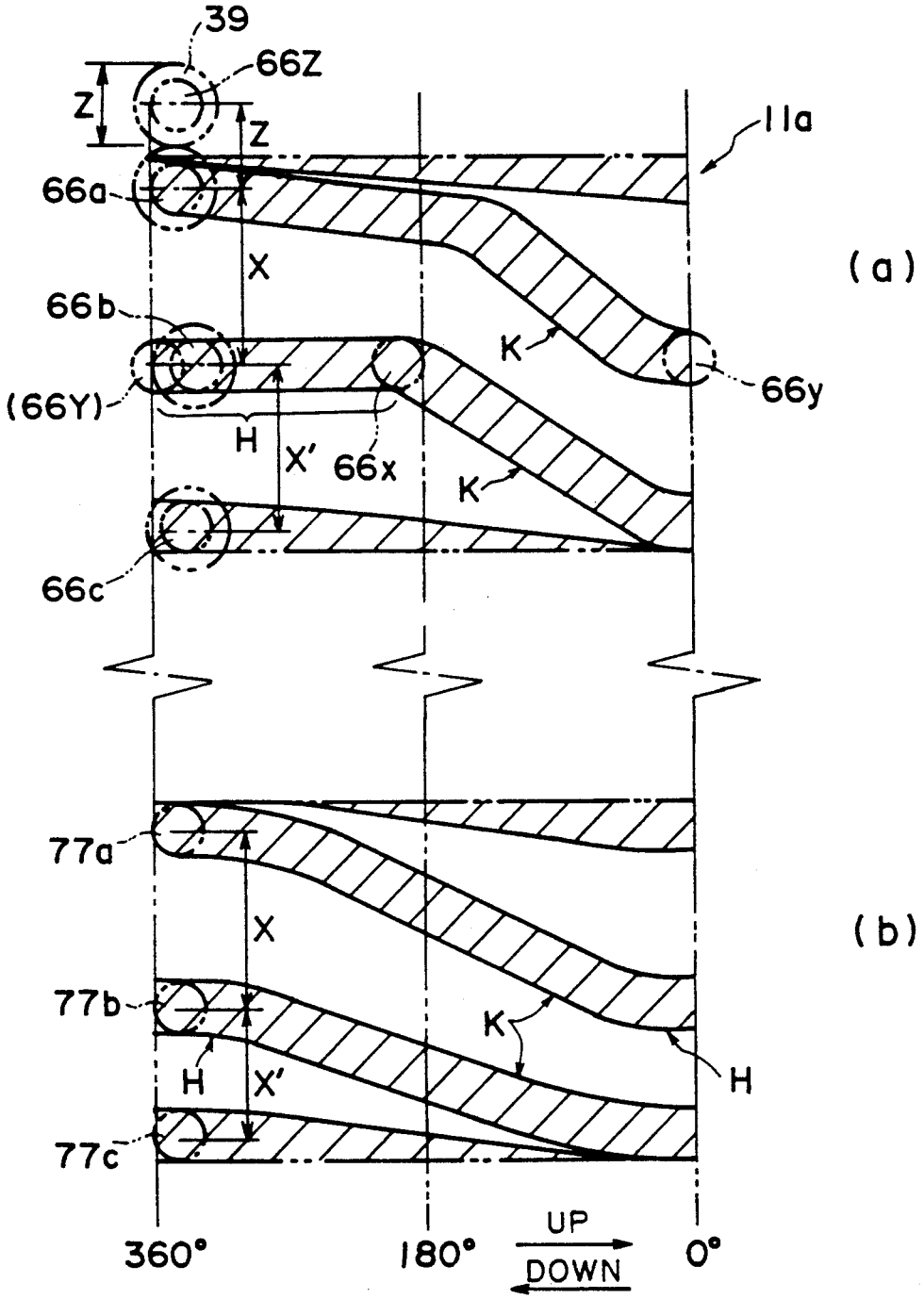
FIG. 6 is a cam diagram of the lead cam.
Figure 7:
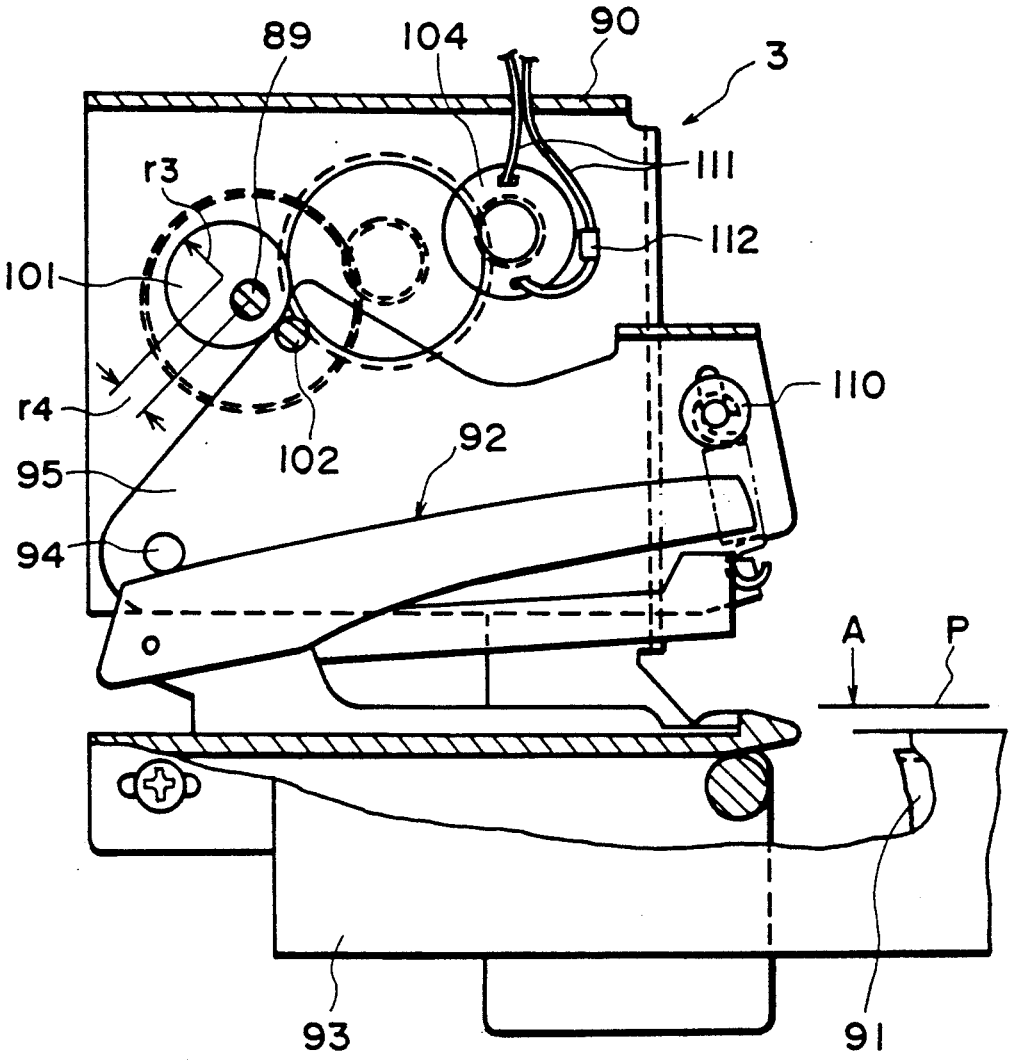
FIG. 7 is a longitudinal sectional view of a stapler in a stapler unit used with this invention.

The description will be made as to sequential operations in which the sheets P discharged from the image forming apparatus M are sorted and stapled in the sorting mode. As shown in FIG. 6, (a), the lead cam is in the form of a double threaded screw to permit expansions of the inter-bin gaps X and X' so as to permit the stapler unit to enter and retract during the stapling operation, in this embodiment.

When the lead cam **11*a* and 11*b* are rotated in the opposite directions from each other by the shift motor 14, the trunnions 33 are urged into the grooves of the lead cams 11*a* and 11*b*, and are raised or lowered along the guide rails 51**.

FIG. 6 at (a), shows the cam diagram of the lead cam **11*a* in this embodiment. FIG. 6 at (b), shows a cam diagram of a conventional lead cam. In the diagrams, the hatched portions correspond to the cam grooves of the lead cam 11*a*. Both of the cam diagrams are for the cams at the leftside as seen in the direction of the advancement of the sheet P. The cam diagrams for the other lead cams 11*b*** are mirror symmetries. The diagrams cover the range of 0–360 degrees, and the cam diagram of this embodiment is in the form of a double threaded screw.

The position of the trunnion 31 in the groove of the lead cam **11*a* is indicated by a reference numeral 66*a*, 66*b* and 66*c*. A reference character H designates a parallel position of the lead cam 11*a*, which extends over approx. 180 degrees in this embodiment. When the lead cam 11*a* moves to the right in this cam diagram, that is when the lead cam 11*a* rotates in the clockwise direction in FIG. 2 (the trunnion 31 moves to the left relatively), the bin 30 is raised. When the lead cam 11*a* moves to the left (the trunnion 31 moves to the right relatively). The bin 30 is lowered. The parallel portion H corresponds to the sheet discharging position of the lead cam 11*a***, and the tapered portion K indicates the shifting position.

It is assumed in this embodiment that one complete circumference of the lead cam **11*a* or 11*b* is $2\pi$ (rad). that the parallel portion H extends over $\theta$ (rad) and that the time period in which the sheet P passes through the lower discharging rollers 12 is t1, the number of revolutions R1 (rpm) of the lead cam 11*a*** is expressed by the following equation:

$$R1 = 60\theta / 2\pi 1 \quad (1)$$

Therefore, the number of revolutions of the lead cam 11*a* (process speed) is increased with decrease of the discharging period of the sheet P.

The sheet interval between adjacent sheets when the sheet P are continuously discharged from the image forming apparatus, is assumed t2. Then, in order to match the one rotation of the lead cam 11*a* with the sheet discharging time plus the sheet interval, the number of revolutions R2 (rpm) of the lead cam in the remaining $(2\pi-\theta)$ period (the tapered portion of the lead cam 11*a*) is:

$$R2=60(2\pi-\theta)/2\pi t2 \quad (2)$$

If the angle $\theta$ of the parallel portion H of the lead cam 11*a* so as to satisfy R1=R2, the rotational speed of the lead cam 11*a* is constant during the sheet discharging and sheet interval periods, theoretically. Therefore, it becomes possible for the bin B to receive the sheet P and to shift the bin, without stopping rotation of the lead cam 11*a*. In other words, the series of sequential sheet sorting operations for the sheet P discharged from the image forming apparatus can be accomplished, while rotating the lead cam 11 at the constant rotational speed.

When the image forming apparatus is a high speed apparatus, the time period t2 becomes small. In such a case, even if the constant speed rotation of the lead cam 11 is not possible, the two speed control (R1–R2) may be enough to prevent stoppage of the lead cam 11, although the rotational speed of the lead cam 11*a* is not constant.

Thus, the noise due to the inertia of the bin unit at the time of the start and stop of the lead cam in the bin-movable type sorter, can be avoided in this embodiment.

Furthermore, according to this embodiment of the present invention, the sorter is usable with a even higher speed copying machine (high productivity copying machine). More particularly, by modifying the angle $\theta$ of the parallel portion of the lead cam 11*a* to a certain degree (more than 180 degrees, for example), the rotating angle of the lead cam 11 between sheet interval becomes small correspondingly, and therefore, the apparatus is usable with the high productivity copying machine (operable at a speed higher than in the conventional apparatus) even if the rotational speed of the lead cam 11*a* is lowered.

In addition, the necessity for the on-off control (start and stop) of a large mass unit (bin unit 2), can be avoided, and therefore, the power consumption loss of the copying machine can be reduced.

The description will be made as to the operation of the sheet separating device in the non-sorting mode.

In the non-sorting mode, the sheets P are stacked on the topmost of the bins. In order to permit a large number of sheets to be stacked on a bin, a longer distance is desired between a nip of the conveying roller 12 and the topmost bin 30. In view of this, the topmost bin 30 is shifted by one bin from a first position 30A for the normal sorting mode position to a second position 30B.

However, with the shift-down position, the distance between the nip of the rollers 20 and the stacking position is too large with the result of poor alignment of the sheets as compared with the case of the sorting mode.

In addition, the staplable number of the sheets of the stapler unit 3 is limited to a certain extent. Therefore, the good sheet alignment is desirable for the number of sheets lower than the staplable number, but very good alignment is not required when the number of sheets is larger, since then the sheets can not be stapled.

Therefore, when the stacked sheets are to be stapled in the non-sorting mode, the alignment is required even if the mode is the non-sorting mode. In consideration of the above, the sheets are received by the bin at the first position 30A (sorting position) as far as the number of the sheets is less than the staplable number, and subsequently, the sheets are received by the bin located at the shift down position (second position) 30A to permit stacking of a larger number of sheets. In the case of normal copying operations, the number of copies to be taken is not more than 20 in most cases. The shift up and down actions each time of depression of the copy button is noisy and decreases durability.

The description will be made as to a series of operations in which the sheets P discharged from the image forming apparatus M are stacked in the non-sorting mode.

With the home position, the trunnion 31 of the topmost bin 30 is located at a position 66*b* in FIG. 6, (a). A dummy trunnion 52 and the upper guide pin 43 are located at the positions 66*a* and 66*z*, respectively. In this embodiment, when the copy button of the image forming apparatus M is actuated without selection of the sorting mode, the non-sorting mode is automatically selected.

In response to this selection, the sheets P discharged from the image forming apparatus M are stacked sequentially on the topmost bin 30 which is located at the home position 30A. When the number of sheets reaches the staplable number (20 in this embodiment), the event detected by the counter of the microcomputer of the sorter main assembly is informed of the shift motor control circuit so that the shift motor 14 is rotated in the counterclockwise direction in FIG. 2 to rotate the lead cam 11*a* in one full turn.

In response thereto, the trunnion 31 of the topmost bin 30 is shifted from the position 66*b* to the position 66*c* in FIG. 6, (a), and the dummy trunnion 52 is shifted from the position 66*a* to the position 66*b*, and in addition, the upper guide pin 43 is shifted down from the position 66*z* to the position 66*a*. In this manner, the distance from the nip between rollers 12 to the topmost bin 30 is increased by a distance X'. The distance X' is properly selected so as to permit a larger number of sheets P than 20 without interference of the trailing edges of the sheets P with the rollers 12. According to this embodiment, at least 100 sheets can be stacked.

Since the dummy trunnion 52 shifts down by the distance X, the upper guide bin 43 shifts down by a small distance z which corresponds to the outer configuration of its supporting portion 39. For this reason, the distance of the shift down of the bin unit 2 relative to the sorter main assembly 1 is very small (z). Thus, the cumbersome operation of the bin unit can be significantly removed without deteriorating the required alignment of the stacked sheets for the stapling after the operation of the non-sorting mode. Thus, the sheet stapling is still assured despite the permission of the stacking of the large number of sheets.

In this embodiment, a trunnion is used for the engagement between the sliding member and the lead cam, but a part of the bin itself may be used in place thereof.

Figure 16:
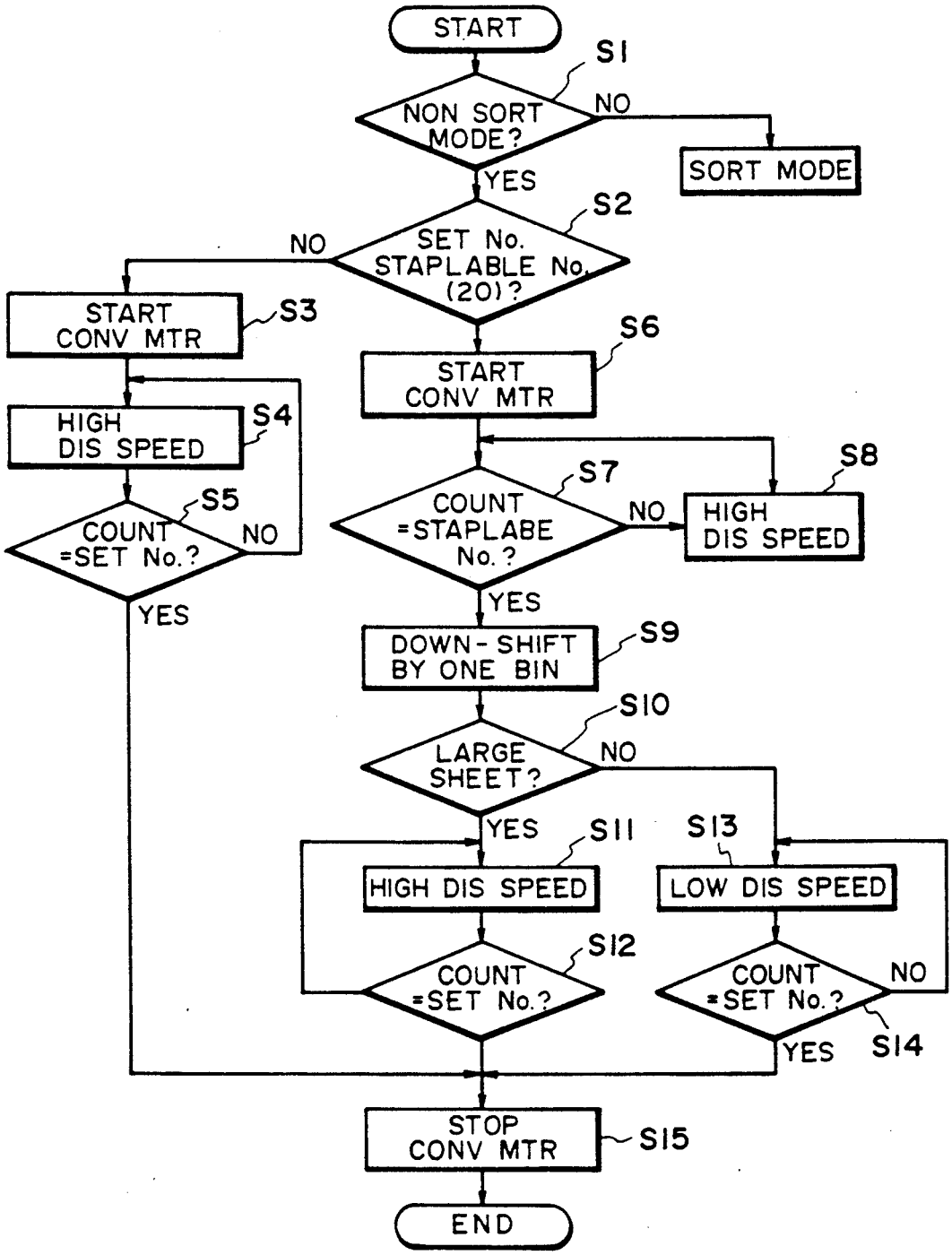
FIG. 16 is a flow chart of sequential operations for stacking the sheets in the non-sorting mode.

Referring to FIG. 16, the bin shifting operation in the non-sorting mode will be described.

The operator selects non-sorting mode or sorting mode on an operation panel not shown. Then, the operator further sets the number of copies to be taken, and depresses a copy starting switch (not shown). When the non-sorting mode is selected (S1), the bins are moved as in the sorting mode so that the topmost bin 30 is located at the first position 30A which is close to the rollers 12. However, if the topmost bin 30 is already at such a position at the time of the starting, this movement is omitted.

If the set number is smaller than the staplable number for the stapling means 3, the conveying motor 50 (FIG. 14) rotates at a high speed to increase the sheet discharging speed of the sheet discharging rollers 12 (S3, S4). The leading portion of the discharged sheet is retarded by the friction because of the small distance between the bin 30 and the sheet discharging outlet, and therefore, the sheet P does not jump to far. When the microcomputer in the sorter 1 counts the set number (S5), the conveying motor 60 is stopped (S15).

When the set number is larger than the staplable number, the number of discharged sheets P by the rotation of the motor 60 (S6) is counted. Until the staplable number is reached (S7), the positions of the bins are maintained at the position as in the sorting mode, and the sheet discharging speed by the rollers 12 is high (S8).

When the count of the counter exceeds the staplable number, the bins are shifted down by one bin (S9), so that the topmost bin is shifted to the second position to provide a larger distance between the bin and the nip between rollers 12. At this time, the sheet discharging speed of the rollers 12 is high (S10) if the size of the sheets is large, and is switched to a lower speed if the size of the sheets is small (S13).

In the case of the large size sheet P, when the trailing edge of the sheet P is discharged from the discharging rollers 12, the leading end portions of the sheet is retarded by the sliding friction on the already stacked sheet, and therefore, the alignment of the sheet is not disturbed due to the kick out of the sheet. In the case of the small size sheet, the leading end portion of the sheet is not retarded by the friction, and therefore, it is desirable that the sheet discharging speed is lowered. With the lowered speed the alignment of the sheets is not disturbed due to the kick-out of the sheet. When the count of the large size sheets reaches the preset number (S12) and when the count of the small size sheets reaches the preset number (S14), the motor 60 stops, and the sheet discharging operation is terminated.

As described in the foregoing, the falling action of the sheet from the sheet discharging rollers to the topmost bin in the non-sorting mode, is controlled depending on whether the number of stacked sheets is larger or smaller than the staplable number, more particularly, the falling distance is smaller until the staplable number is reached to assure the sheet alignment, and therefore, the sheets can be stapled in good order. When the number exceeds the staplable number, the falling distance can be increased to permit stacking of the larger number of sheets.

Even when the falling distance is large, the sheet discharging speed is changed in accordance with the length of the sheet measured in the sheet conveying direction, so that the large number of sheets can be stacked in alignment with each other In consideration of the fact that in most copy operations the number of copies does not exceed the staplable number, the cumbersome shift down and up operations of the bins each time the copying operation is started, can be avoided.

In the case where the number of the copies to be taken is larger than the staplable number, the topmost bin may be shifted to the second position from the start. In this case, if the size of the sheets is large, the sheets are discharged at the high speed from the start, and if it is small, the sheets are discharged at the lower speed from the start.

Figure 17:
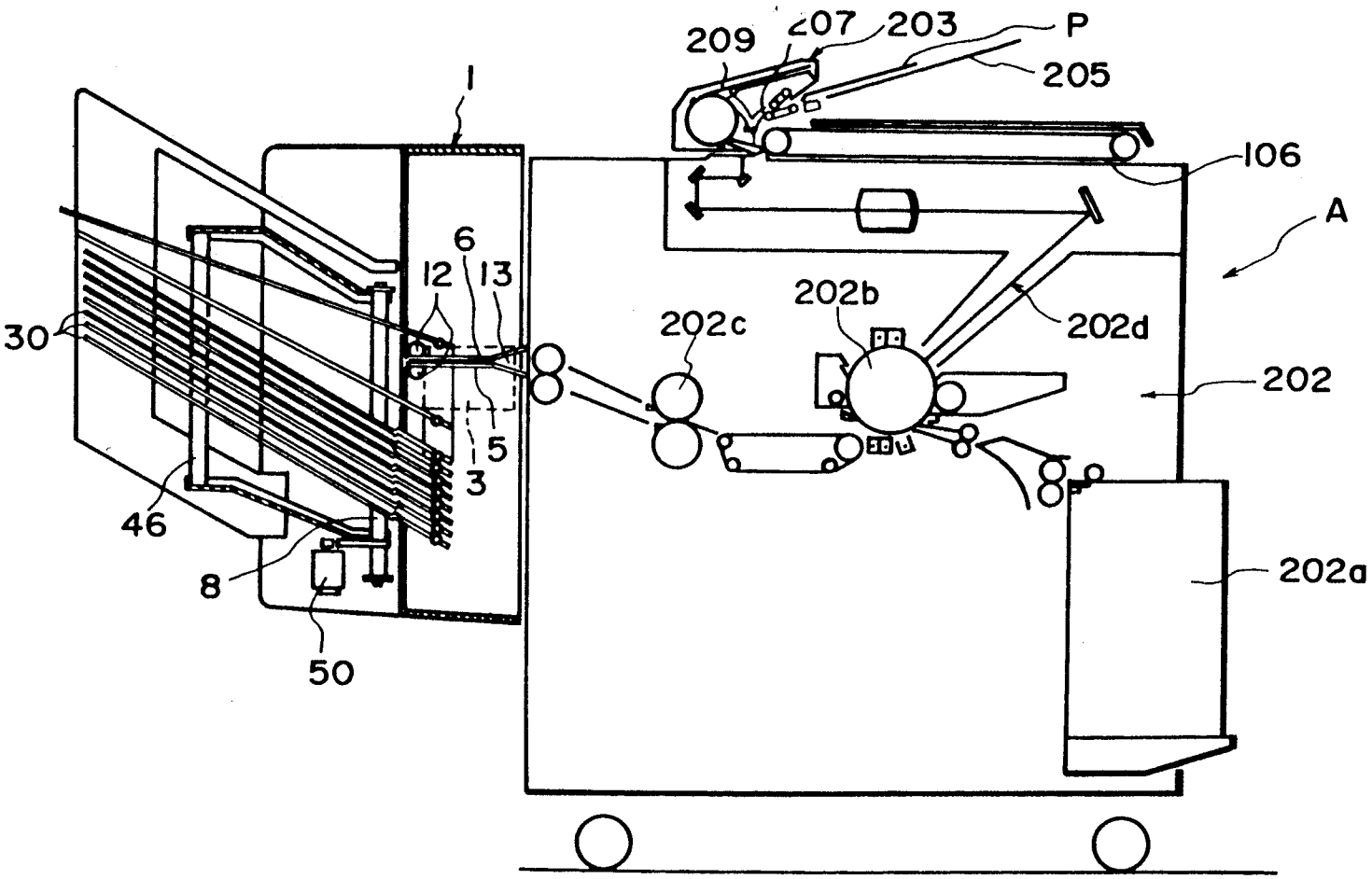
FIG. 17 is a sectional view of a copying machine and a sheet sorter attached thereto.
Figure 18:
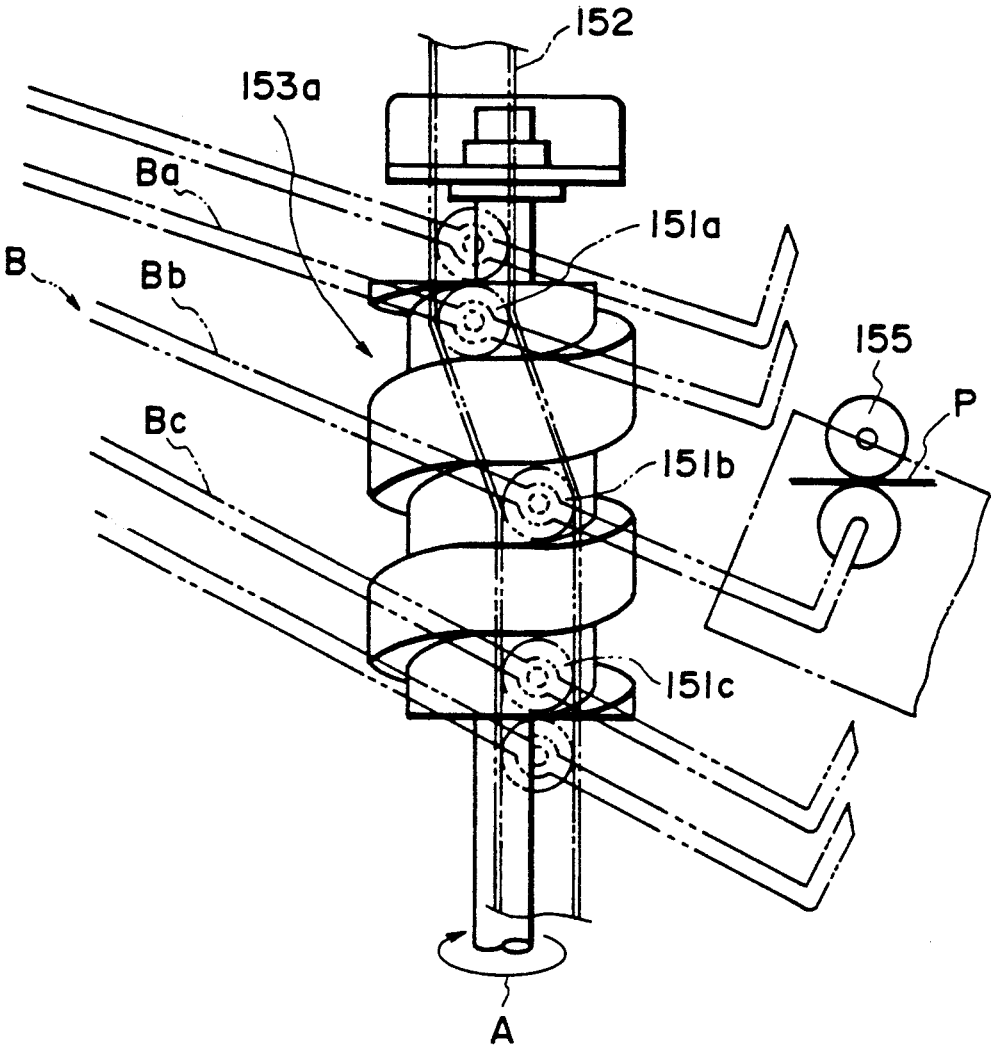
FIG. 18 is a side view of a major part of a conventional sheet sorting apparatus.
Figure 19:
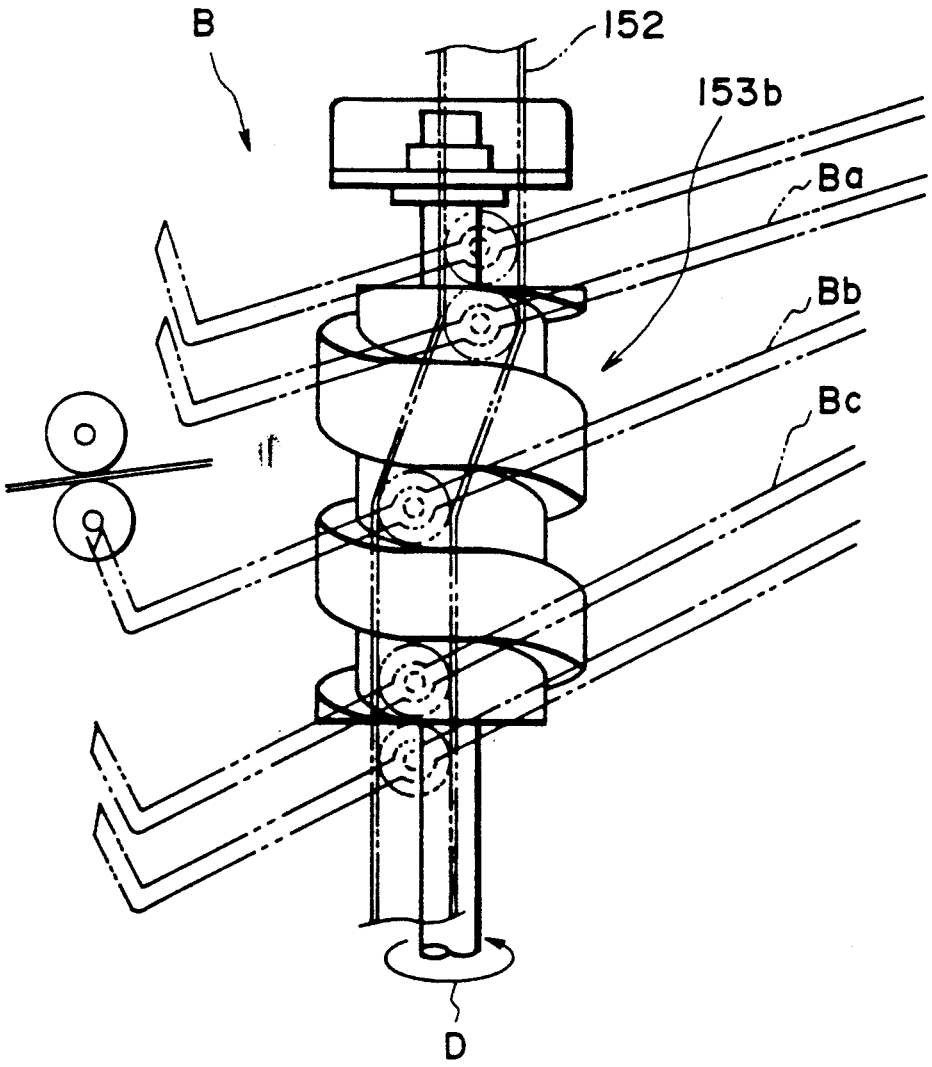
FIG. 19 is a side view of a major part thereof.
Figure 20:
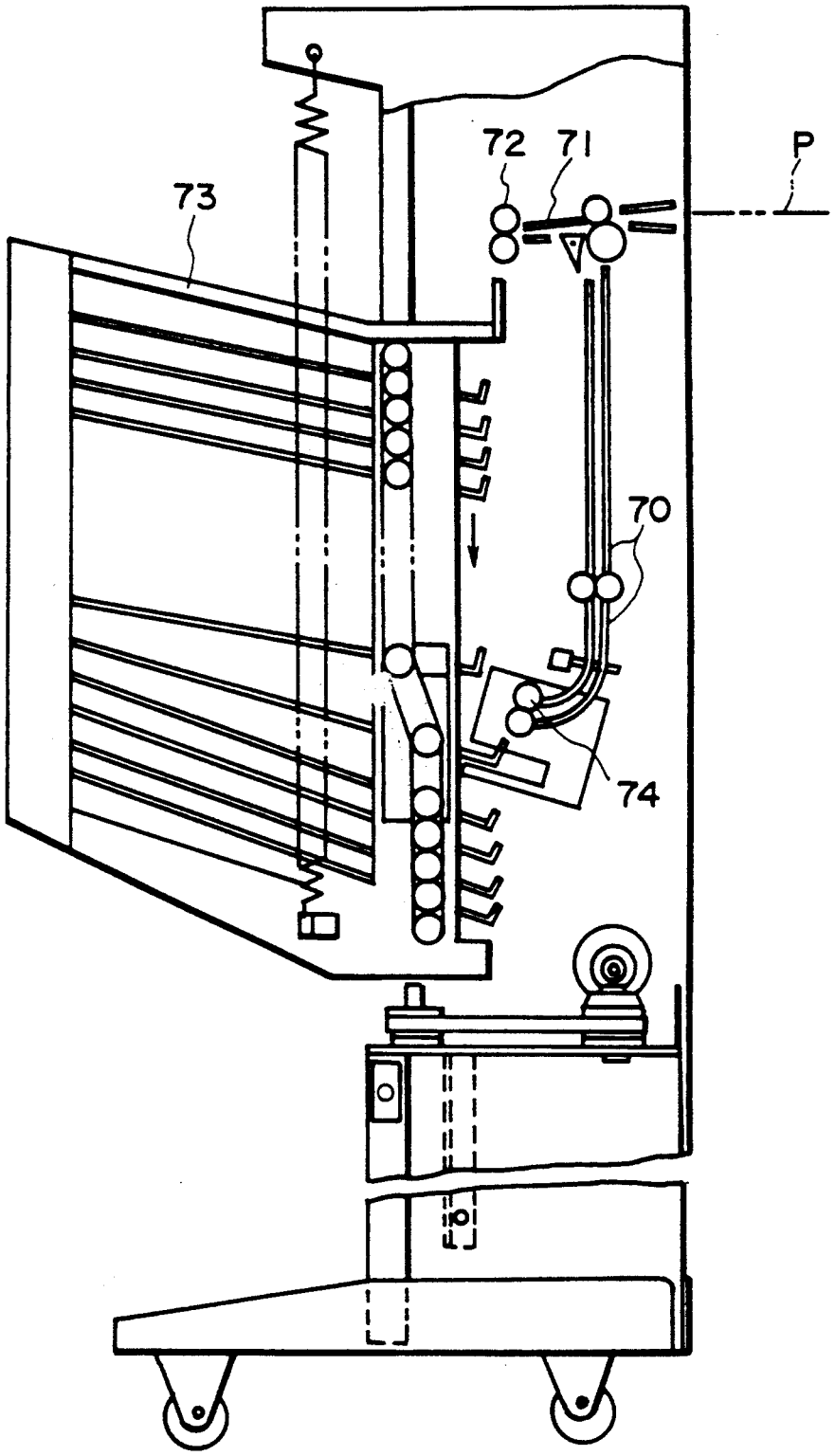
FIG. 20 is a longitudinal sectional view of the entirety of the sheet sorting apparatus.
Figure 21:
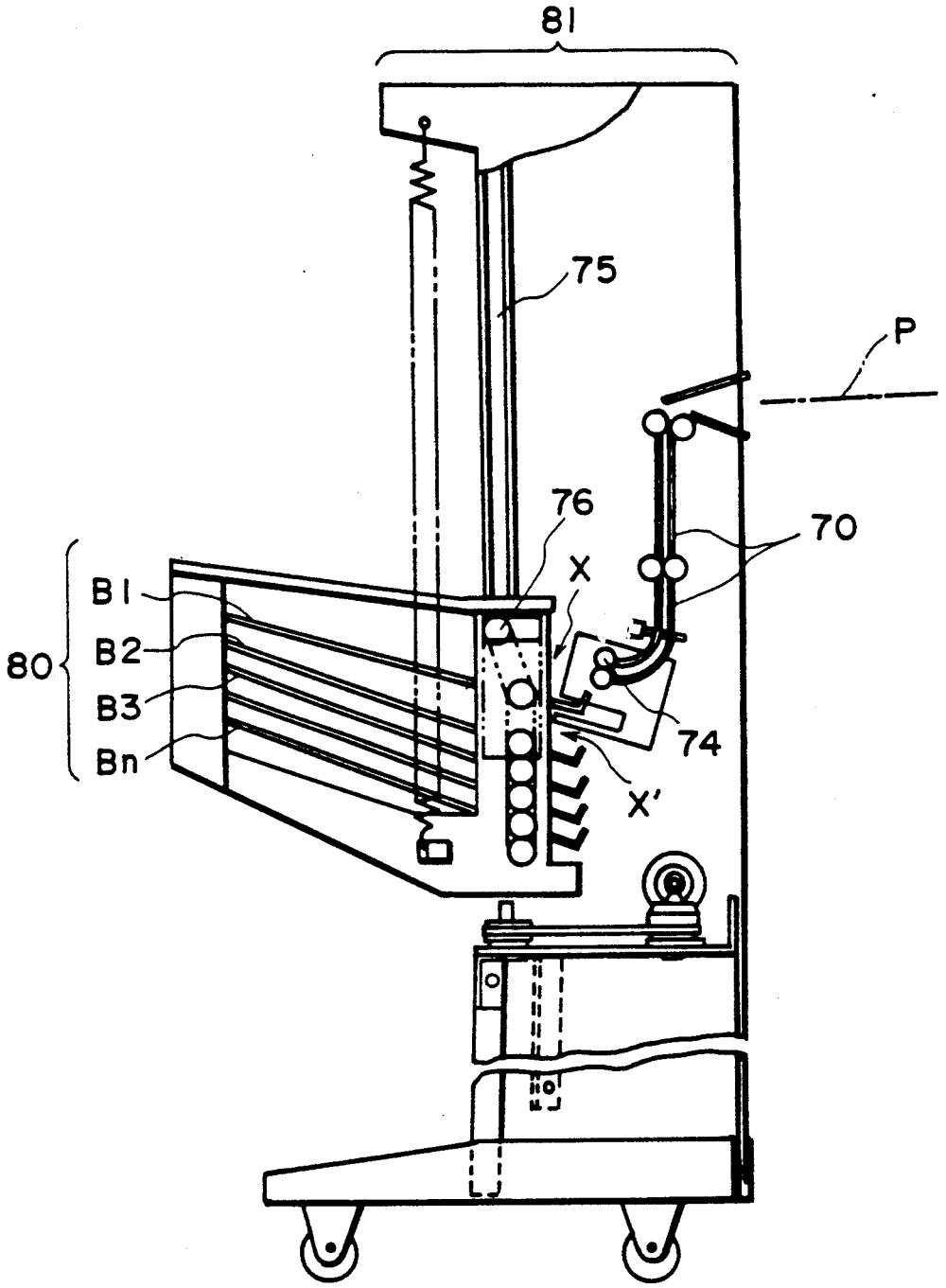
FIG. 21 is a longitudinal sectional view of another conventional sheet sorting apparatus.
Figure 22:
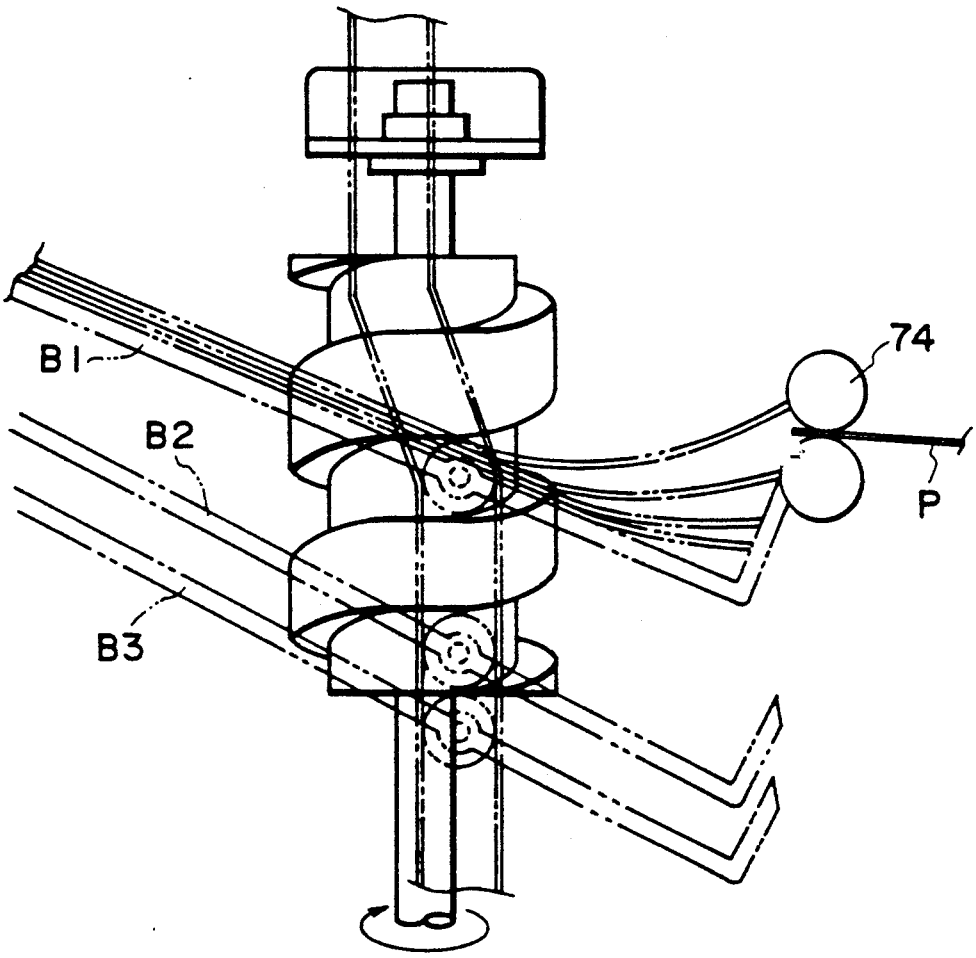
FIG. 22 is a side view of the same.
Figure 23:
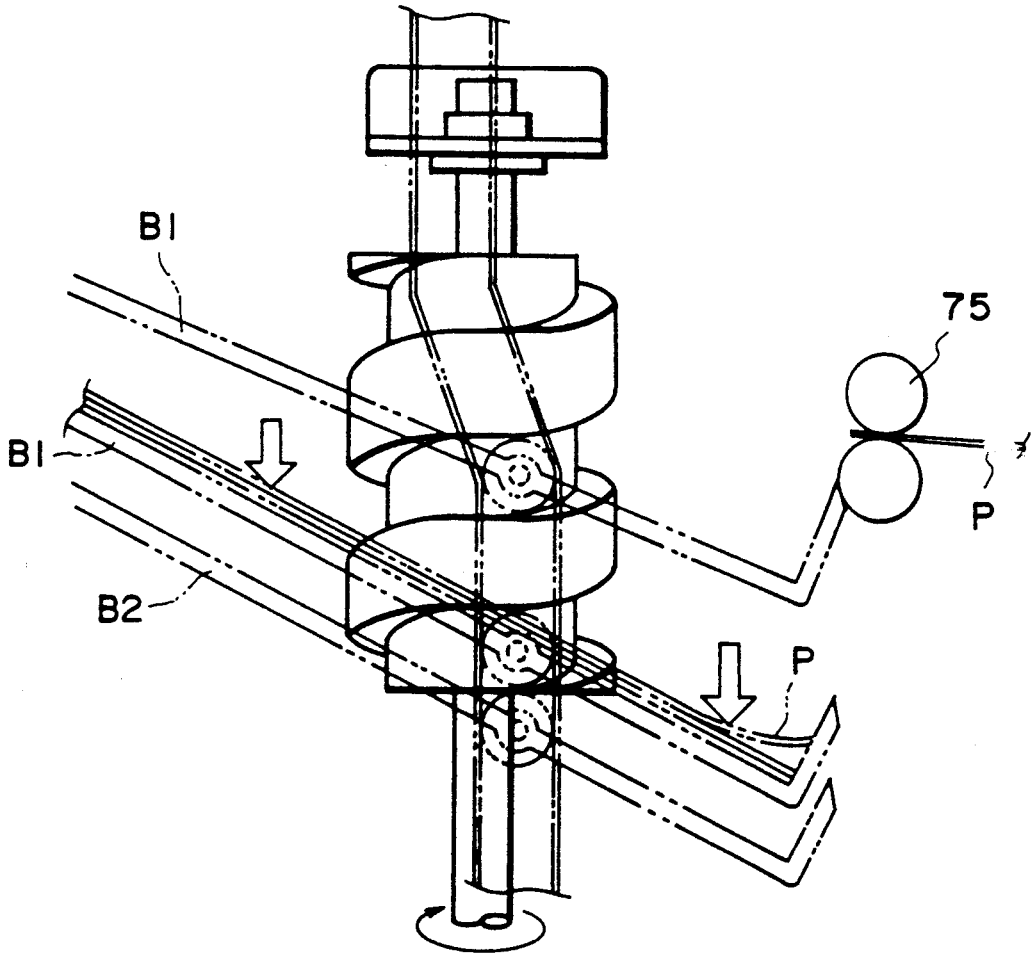
FIG. 23 illustrates the operation of the conventional apparatus.

FIG. 17 is a sectional view of a more specific structure of the image forming apparatus A. As shown in this Figure, the image forming apparatus A comprises a copying machine 202 including a deck 202*a*, a photosensitive member 202*b*, an image fixing device 202*c* and a reading device 202*d*, an automatic document feeder 202 disposed above the copying machine 202.

The original document P stacked on the original stack 205 of the automatic document feeder 203 is sequentially separated from the bottom of the stack and is fed onto a platen glass 206 of the copying machine 202 via a path 207. The original document is read by the optical system of the copying machine 202, and is then discharged to the topmost of the original stacking tray 205 along a path 209 from the platen glass.

While the invention has been described with reference to the structures disclosed herein, it is not confined to the details set forth and this application is intended to cover such modifications or changes as may come within the purposes of the improvements or the scope of the following claims.

What is claimed is:

1. A sheet sorting appa tus operable in a sorting mode in which sheets are sorted and in a non-sorting mode in which the sheets are not sorted, comprising:

a plurality of bins for receiving and sorting the sheets;

binding means for binding the sheets accommodated in said bins;

wherein one of said plural bins functions to receive the sheets in the non-sorting mode;

means for changing a sheet accommodating space of said bin for receiving the sheets in the non-sorting mode; and control means for operating said space changing means to expand the accommodating space when a number of sheets received by said bin is larger than a bindable number of the sheets of said binding means.

2. An apparatus according to claim 1, wherein said control means includes counting means for counting the number of sheets, wherein when a count of said counting means reaches the bindable number of the sheets, said control means operates said changing means to expand the accommodating space.

3. An apparatus according to claim 1, further comprising means for moving said bins up and down to receive the sheets in a sorted manner.

4. An apparatus according to claim 3, wherein said bin moving means includes a trunnion for each bin, and a lead cam engageable with one of said trunnions, wherein the trunnion moves up and down by rotation of the lead cam to move said bins up and down.

5. An apparatus according to claim 4, wherein said lead cam has such a cam surface that a space between adjacent bins is larger when the space is to receive the sheet than the space between other adjacent bins.

6. An apparatus according to claim 5, wherein said bins are supported on a frame which is movable up and down as an integral bin unit, so that said bins are movable as a whole by moving the unit.

7. An apparatus according to claim 6, a dummy trunnion is disposed above the trunnion of a topmost bin to reduce movement distance of said unit when the sheet accommodating space is increased by rotation of the lead cam.

8. An apparatus according to claim 1, wherein said bin for receiving the sheets in the non-sorting mode is a topmost one of said bins.

9. An apparatus according to claim 1, further comprising means for changing a speed at which the sheets are received by said bins, said receiving speed changing means changing the speed to be lower when the sheet accommodating space is expanded in the non-sorting mode that when the accommodating space is not expanded.

10. An apparatus according to claim 1, further comprising means for changing a speed at which the sheets are received by said bins, wherein the speed is higher for larger sheets in the non-sorting mode.

11. An apparatus according to claim 1, wherein said binding means is a stapler.

12. An image forming apparatus operable in a sorting mode in which sheets are sorted and in a non-sorting mode in which the sheets are not sorted, comprising:

a plurality of bins for receiving and sorting the sheets;

binding means for binding the sheets accommodated in said bins;

wherein one of said plural bins functions to receive the sheets in the non-sorting mode;

means for changing a sheet accommodating space of said bin for receiving the sheets in the non-sorting mode; and control means for operating said space changing means to expand the accommodating space when a number of sheets to be received or received by said bin is larger than a bindable number of the sheets of said binding means.

13. An apparatus according to claim 12, wherein said control means includes means for inputting a number of sheets on which images are formed, and the accommodating space is expanded when the number inputted is larger than a bindable number of said binding means.

14. An apparatus according to claim 12, wherein said control means includes counting means for counting a number of sheets on which the images are formed, wherein when a count of said counting means reaches the bindable number, said changing means expands the accommodating space.

* * * * *

UNITED STATES PATENT AND TRADEMARK OFFICE

CERTIFICATE OF CORRECTION

PATENT NO. : 5,282,611
DATED : February 1, 1994
INVENTOR(S) : NORIYOSHI UEDA, ET AL.

It is certified that error appears in the above-indentified patent and that said Letters Patent is hereby corrected as shown below:

On the Title Page,
item [56], "72568 10/1980 Japan" should read --72568 5/1982 Japan--.

Column 1,
Line 12, "spaced" should read --space--.

Column 11,
Line 65, "other" should read --other.--.

Column 13,
Line 19, "that" should read --than--.

FIGURE 15,
"FLAPSED" should read --ELAPSED--.

Signed and Sealed this
Second Day of August, 1994

Attest:

Bruce Lehman

BRUCE LEHMAN

Attesting Officer

Commissioner of Patents and Trademarks